US010753203B2

(12) United States Patent
Ameen

(10) Patent No.: US 10,753,203 B2
(45) Date of Patent: Aug. 25, 2020

(54) SYSTEMS AND METHODS TO IDENTIFY AND INHIBIT SPIDER WEB BOREHOLE FAILURE IN HYDROCARBON WELLS

(71) Applicant: Saudi Arabian Oil Company, Dhahran (SA)

(72) Inventor: Mohammed S. Ameen, London (GB)

(73) Assignee: Saudi Arabian Oil Company, Dhahran (SA)

( * ) Notice: Subject to any disclaimer, the term of this patent is extended or adjusted under 35 U.S.C. 154(b) by 252 days.

(21) Appl. No.: 16/031,374

(22) Filed: Jul. 10, 2018

(65) Prior Publication Data

US 2020/0018159 A1 Jan. 16, 2020

(51) Int. Cl.
*E21B 49/00* (2006.01)
*E21B 47/002* (2012.01)
*E21B 47/14* (2006.01)

(52) U.S. Cl.
CPC ..... *E21B 49/006* (2013.01); *E21B 47/002* (2020.05); *E21B 47/14* (2013.01); *E21B 49/008* (2013.01)

(58) Field of Classification Search
CPC ..... E21B 49/006; E21B 47/002; E21B 47/14; E21B 49/008; E21B 47/00
See application file for complete search history.

(56) References Cited

U.S. PATENT DOCUMENTS 3,586,105 A 6/1971 Johnson et al.
3,739,781 A 6/1973 Patel
(Continued)

FOREIGN PATENT DOCUMENTS

CN 103389247 A 11/2013
CN 103472498 A 12/2013
(Continued)

OTHER PUBLICATIONS

Barton, Colleen A. et al.; "In-Situ Stress Orientation and Magnitude at the Fenton Geothermal Site, New Mexico, Determined from Wellbore Breakouts" Geophysical Research Letters, v. 15, No. 5; pp. 467-470.
(Continued)

*Primary Examiner* — Michael R Wills, III
(74) *Attorney, Agent, or Firm* — Bracewell LLP; Constance G. Rhebergen; Christopher L. Drymalla

(57) ABSTRACT

Determining, based on asymmetric spalling of rock at a wall of a wellbore of a hydrocarbon well, that the wellbore is experiencing a spider web borehole failure (SWBF); and in response to the determination: generating a forward model of rock strength for the well (including a rock strength reduction function defining a rock strength reduction factor (r) as a function of angular width of a borehole failure (W)); determining an angular width of the SWBF ($W_{SWBF}$); determining, based on application of the angular width of the SWBF ($W_{SWBF}$) to the rock strength reduction function, a rock strength reduction factor (r) for the well; determining, based on the rock strength reduction factor (r) and an unconfined compressive strength of intact rock ($C_o$), an unconfined compressive strength of fractured rock ($C_{frm}$); and operating the well based on the unconfined compressive strength of fractured rock ($C_{frm}$).

26 Claims, 8 Drawing Sheets

(56) References Cited

U.S. PATENT DOCUMENTS

| | | | |
|---|---|---|---|
| 3,796,091 | A | 3/1974 | Serata |
| 3,992,928 | A | 11/1976 | Thoms |
| 4,005,750 | A | 2/1977 | Shuck |
| 4,044,828 | A | 8/1977 | Jones et al. |
| 4,109,717 | A | 8/1978 | Cooke, Jr. |
| 4,254,828 | A | 3/1981 | Sowa et al. |
| 4,291,581 | A | 9/1981 | Jacoby |
| 4,340,934 | A | 7/1982 | Segesman |
| 4,393,933 | A | 7/1983 | Nolte et al. |
| 4,453,595 | A | 6/1984 | Lagus et al. |
| 4,695,957 | A | 9/1987 | Peltier |
| 4,710,906 | A | 12/1987 | Bradley et al. |
| 4,794,534 | A | 12/1988 | Millheim |
| 4,879,654 | A | 11/1989 | Bruce |
| 5,050,690 | A | 9/1991 | Smith |
| 5,165,276 | A | 11/1992 | Thiercelin |
| 5,295,393 | A | 3/1994 | Thiercelin |
| 5,417,116 | A | 5/1995 | Solomon et al. |
| 5,743,334 | A | 4/1998 | Nelson |
| 5,838,634 | A | 11/1998 | Jones et al. |
| 5,895,437 | A | 4/1999 | Di Cesare et al. |
| 5,995,446 | A | 11/1999 | Meyer et al. |
| 6,009,747 | A | 1/2000 | Dos Santos |
| 6,151,961 | A | 11/2000 | Huber et al. |
| 6,170,440 | B1 | 1/2001 | Monnier et al. |
| 6,173,773 | B1 | 1/2001 | Almaguer et al. |
| 6,256,603 | B1 | 7/2001 | Celniker |
| 6,408,953 | B1 | 6/2002 | Goldman et al. |
| 6,549,854 | B1 | 4/2003 | Malinverno et al. |
| 6,609,067 | B2 | 8/2003 | Tare et al. |
| 6,766,254 | B1 | 7/2004 | Bradford et al. |
| 6,832,158 | B2 | 12/2004 | Mese et al. |
| 6,834,233 | B2 | 12/2004 | Economides et al. |
| 8,126,689 | B2 | 2/2012 | Soliman et al. |
| 8,146,416 | B2 | 4/2012 | Pisio et al. |
| 8,374,836 | B2 | 2/2013 | Yogeswaren |
| 8,600,716 | B2 | 12/2013 | Bradford |
| 8,736,263 | B2 | 5/2014 | Minh |
| 8,991,520 | B2 | 3/2015 | Kulkarni et al. |
| 9,411,071 | B2 | 8/2016 | Gray et al. |
| 9,646,115 | B2 | 5/2017 | Frydman |
| 9,719,332 | B2 | 8/2017 | Zamora et al. |
| 2002/0010548 | A1 | 1/2002 | Tare et al. |
| 2003/0150263 | A1 | 8/2003 | Economides et al. |
| 2003/0168257 | A1 | 9/2003 | Aldred et al. |
| 2003/0212495 | A1 | 11/2003 | Mese et al. |
| 2004/0122640 | A1 | 6/2004 | Dusterhoft |
| 2004/0176911 | A1 | 9/2004 | Bratton et al. |
| 2005/0113262 | A1 | 5/2005 | Ravi et al. |
| 2005/0161262 | A1 | 7/2005 | Jamison |
| 2006/0153005 | A1 | 7/2006 | Herwanger et al. |
| 2006/0285437 | A1 | 12/2006 | Sinha et al. |
| 2007/0027036 | A1 | 2/2007 | Polizzotti et al. |
| 2007/0289741 | A1 | 12/2007 | Rambow |
| 2007/0294034 | A1 | 12/2007 | Bratton et al. |
| 2008/0190190 | A1 | 8/2008 | Tan et al. |
| 2008/0319675 | A1 | 12/2008 | Sayers |
| 2009/0070043 | A1 | 3/2009 | Ryu et al. |
| 2009/0132218 | A1 | 5/2009 | Ledgerwood, III |
| 2009/0151937 | A1 | 6/2009 | Goodwin et al. |
| 2009/0163388 | A1 | 6/2009 | Reddy et al. |
| 2010/0155142 | A1 | 6/2010 | Thambynayagam et al. |
| 2010/0243328 | A1 | 9/2010 | Rodriguez Herrera |
| 2011/0125333 | A1 | 5/2011 | Gray |
| 2011/0153296 | A1 | 6/2011 | Sadlier et al. |
| 2011/0198076 | A1 | 8/2011 | Villreal |
| 2013/0138410 | A1 | 5/2013 | Yogeswaren |
| 2013/0275099 | A1 | 10/2013 | Frydman |
| 2014/0326449 | A1 | 11/2014 | Samuel et al. |
| 2015/0090498 | A1 | 4/2015 | Hareland |
| 2015/0168597 | A1 | 6/2015 | Bai |
| 2016/0033382 | A1 | 2/2016 | Jamison et al. |
| 2017/0009575 | A1 | 1/2017 | Liu et al. |
| 2017/0145793 | A1 | 5/2017 | Ouenes |
| 2017/0267909 | A1 | 9/2017 | Jin et al. |
| 2017/0362935 | A1 | 12/2017 | Batmaz et al. |
| 2018/0149000 | A1* | 5/2018 | Roussel ..... E21B 41/0092 |
| 2019/0264559 | A1* | 8/2019 | Han ..... E21B 49/006 |
| 2019/0353033 | A1* | 11/2019 | Ameen ..... E21B 49/00 |

FOREIGN PATENT DOCUMENTS

| | | | |
|---|---|---|---|
| CN | 104594867 | A | 5/2015 |
| EP | 0527089 | A2 | 2/1993 |
| WO | WO199727502 | A1 | 7/1997 |
| WO | WO2008098031 | A1 | 8/2008 |
| WO | WO2008147762 | A1 | 12/2008 |
| WO | WO2010093533 | A2 | 8/2010 |

OTHER PUBLICATIONS

Bell, J.S. and Gough, D.I.; "Northeast-southwest compressive stress in Alberta: evidence from oil wells" Earth and Planetary Science Letters, 45 (1979), pp. 475-482.

Bell, J.S. and Gough, D.I.; "The Use of Borehole Breakouts in the Study of Crustal Stress" US Geological Survey Report, 1982; pp. 539-557.

Dart, Richard L. et al.; "Principal Stress Directions on the Atlantic Continental Shelf Inferred from the Orientations of Borehole Elongations" U.S. Geological Survey Open-File Report 87-283 1987; pp. 1-45.

Dart, Richard L. et al.; "Wellbore Breakout Stress Analysis Within the Central and Eastern Continental United States" The Log Analyst Jan.-Feb. 1989; pp. 12-25.

Dart, Richard L.; "In Situ Stress Analysis of Wellbore Breakouts from Oklahoma and the Texas Panhandle" U.S. Geological Survey Bulletin 1866, Chapter F, pp. 1-34.

Dart, Richard L.; "South-central United States Well-Bore Breakout-Data Catalog" U.S. Geological Survey Open-File Report 87-405 1987, pp. 1-98.

Gough, D.I. and Bell, J.S.; "Stress orientations from oil-well fractures in Alberta and Texas" Can. J. Earth Sci. vol. 18, 1981; pp. 638-645.

Haimson, B.C. and Herrick, C.G.; "Borehole breakouts—a new tool for estimating in situ stress?" Proceedings of the International Sumposium on Rock Stress and Rock Stress Measurements, Stockholm, Sep. 1-3, 1986; pp. 271-280.

Haimson, B.C. and Song, I.; "Laboratory Study of Borehole Breakouts in Cordova Cream: A Case of Shear Failure Mechanism" Int. J. Rock Mech. Min. Scie. & Geomech., 1993, Abstr. vol. 30, No. 7; pp. 1047-1056.

Hickman, Stephen H. et al.; "In Situ Stress, Natural Fracture Distribution, and Borehole Elongation in the Auburn Geothermal Well, Auburn, New York" Journal of Geophysical Research, vol. 90, No. B7, Jun. 10, 1985; pp. 5497-5512.

Marinos, Paul and Hoek, Evert; "GSI: A Geologically Friendly Tool for Rock Mass Strength Estimation" ISRM-IS-2000-035, International Society for Rock Mechanics and Rock Engineering, ISRM Symposium, Nov. 19-24, 2000; pp. 1-19.

Morin, Roger H. et al.; "State of Lithospheric Stress and Borehole Stability at Deep Sea Drilling Project Site 504B, Eastern Equatorial Pacific" Journal of Geophysical Research, vol. 95, No. B6, Jun. 10, 1990; pp. 9293-9303.

Zheng, Ziqiong et al.; "Analysis of Borehole Breakouts" Journal of Geophysical Research, vol. 94, No. B6, Jun. 10, 1989; pp. 7171-7182.

Zoback, Mark D. et al.; "Well Bore Breakouts and in Situ Stress" Journal of Geophysical Research, vol. 90, No. B7, Jun. 10, 1985; pp. 5523-5530.

Ameen et al., "Predicting rock mechanical properties of carbonates from wireline logs (a case study: Arab-D reservoir, Ghawar field Saudi Arabia).", Marine and Petroleum Geology, 2009, pp. 430-444, Elsevier.

Ameen, Mohammed S.; "Fracture and in-situ stress patterns and impact on performance in the khuff structural prospects, eastern offshore Saudi Arabia", Marine and Petroleum Geology, 2014; pp. 166-184.

(56) References Cited

OTHER PUBLICATIONS

International Search Report and Written Opinion for International Application No. PCT/US2019/032795 (SA5859) report dated Jul. 25, 2019; pp. 1-15.
International Search Report and Written Opinion for International Application No. PCT/US2019/041235 (SA5832) report dated Oct. 1, 2019; pp. 1-14.
Prioul et al., "Forward modeling of fracture-induced sonic anistropy using a combination of borehole image and sonic logs.", Geophysics, 2007, pp. E135-E147, vol. 71, No. 4, Society of Exploration Geophysicists.

* cited by examiner

| Rock Mechanical Parameter | Measured/Estimated Value |
|---|---|
| Pore Pressure ($P_o$) | 0.38 psi/ft |
| Mud Weight Gradient ($M_w$) | 0.514 psi/ft +10% |
| Pressure Contrast ($\Delta P$) | 0.134 psi/ft to 0.19 |
| Vertical In-Situ Stress ($\sigma_v$) | 1.08 psi/ft |
| Minimum Horizontal In-Situ Stress ($\sigma_h$) | 0.61-0.68 psi/ft |
| Maximum Horizontal In-Situ Stress ($\sigma_H$) | 0.948 to 1.066 psi/ft |
| Internal Friction | 0.8 (Angle=37°) |
| Poisson's Ratio | 0.2 |
| Azimuth of Minimum Horizontal In-Situ Stress | 155° from North |
| $C_o$ | 11069-16254psi;<br>10000- 21853psi |
| Reservoir temperature | 252°F (0.0253 deg/ft) |

FIG. 5

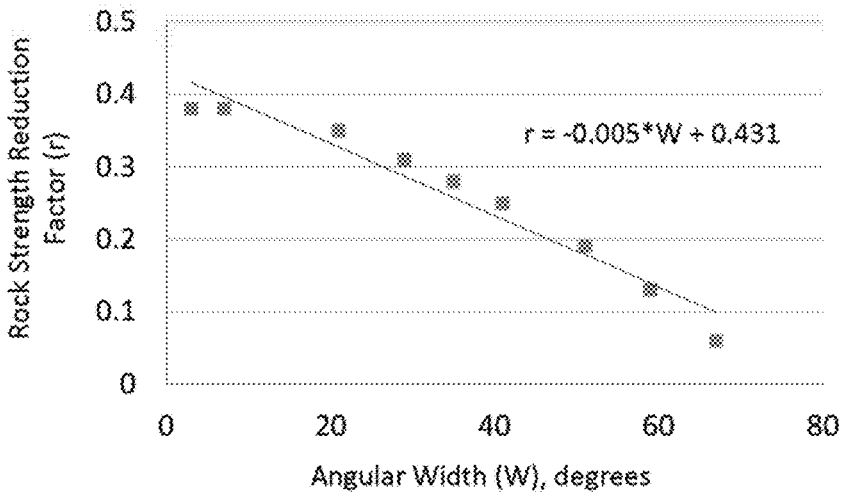

FIG. 6B

| | Parameter | Parameter Value | | | | | | | | | |
|---|---|---|---|---|---|---|---|---|---|---|---|
| Input Parameters | Pore Pressure ($P_o$), psi/ft | 0.39 | 0.38 | 0.38 | 0.38 | 0.38 | 0.38 | 0.38 | 0.38 | 0.38 | 0.38 |
| | Pressure Contrast ($\Delta P$), psi/ft | 0.175 | 0.175 | 0.175 | 0.175 | 0.175 | 0.175 | 0.175 | 0.175 | 0.175 | 0.175 |
| | Vertical In-Situ Stress ($\sigma_v$), psi/ft | 1.08 | 1.08 | 1.08 | 1.08 | 1.08 | 1.08 | 1.08 | 1.08 | 1.08 | 1.08 |
| | Minimum Horizontal In-Situ Stress ($\sigma_h$), psi/ft | 0.64 | 0.64 | 0.64 | 0.64 | 0.64 | 0.64 | 0.64 | 0.64 | 0.64 | 0.64 |
| | Maximum Horizontal In-Situ Stress ($\sigma_H$), psi/ft | 1.066 | 1.066 | 1.066 | 1.066 | 1.066 | 1.066 | 1.066 | 1.066 | 1.066 | 1.066 |
| | Internal Friction | 0.8 | 0.8 | 0.8 | 0.8 | 0.8 | 0.8 | 0.8 | 0.8 | 0.8 | 0.8 |
| | Poisson's Ratio | 0.2 | 0.2 | 0.2 | 0.2 | 0.2 | 0.2 | 0.2 | 0.2 | 0.2 | 0.2 |
| | Modeled Unconfined Compressive Strength of Formation Rock ($C_o'$) | 6200 | 6100 | 6050 | 5500 | 5000 | 4500 | 4000 | 3000 | 2000 | 1000 |
| Predicted Failure | Predicted Breakout Angular Width, degrees | 0 | 3 | 7 | 21 | 29 | 35 | 41 | 51 | 59 | 67 |
| | Drilling Induced Fractures | Yes | Yes | Yes | Yes | Yes | Yes | Yes | Yes | Yes | Yes |
| Lab Determined Unconfined Compressive Strength ($C_o$) | | 15927 | 15927 | 15927 | 15927 | 15927 | 15927 | 15927 | 15927 | 15927 | 15927 |
| Rock Strength Reduction Factor (r), ($C_o'$ / $C_o$) | | 0.39 | 0.38 | 0.38 | 0.35 | 0.31 | 0.28 | 0.25 | 0.19 | 0.13 | 0.06 |

FIG. 6A

SYSTEMS AND METHODS TO IDENTIFY AND INHIBIT SPIDER WEB BOREHOLE FAILURE IN HYDROCARBON WELLS

FIELD

Embodiments relate generally to developing wells, and more particularly to operating hydrocarbons wells to inhibit spider web borehole failure.

BACKGROUND

A well generally includes a wellbore (or "borehole") that is drilled into the earth to provide access to a geologic formation below the earth's surface (or "subsurface formation"). The well may facilitate the extraction of natural resources, such as hydrocarbons and water, from the subsurface formation, facilitate the injection of substances into the subsurface formation, or facilitate the evaluation and monitoring of the subsurface formation. In the petroleum industry, hydrocarbon wells are often drilled to extract (or "produce") hydrocarbons, such as oil and gas, from subsurface formations. The term "oil well" is often used to refer to a well designed to produce oil. Similarly the term "gas well" is often used to refer to a well designed to produce gas. In the case of an oil well, some natural gas is typically produced along with oil. A well producing both oil and natural gas is sometimes referred to as an "oil and gas well" or an "oil well." The term "hydrocarbon well" is often used to describe wells that facilitate the production of hydrocarbons, including oil wells and oil and gas wells.

Creating a hydrocarbon well typically involves several stages, including a drilling stage, a completion stage and a production stage. The drilling stage normally involves drilling a wellbore into a subsurface formation that is expected to contain a concentration of hydrocarbons that can be produced. The portion of the subsurface formation expected to contain hydrocarbons is often referred to as a "hydrocarbon reservoir" or "reservoir." The drilling process is normally facilitated by a drilling rig that sits at the earth's surface. The drilling rig can provide for operating a drill bit to cut the wellbore, hoisting, lowering and turning drill pipe and tools, circulating drilling fluids in the wellbore, and generally controlling various operations in the wellbore (often referred to as "down-hole" operations). The completion stage involves making the well ready to produce hydrocarbons. In some instances, the completion stage includes installing casing pipe into the wellbore, cementing the casing pipe in place, perforating the casing pipe and cement, installing production tubing, installing downhole valves for regulating production flow, and pumping fluids into the well to fracture, clean or otherwise prepare the reservoir and well to produce hydrocarbons. The production stage involves producing hydrocarbons from the reservoir by way of the well. During the production stage, the drilling rig is normally removed and replaced with a collection of valves at the surface (often referred to as "surface valves" or a "production tree"), and valves are installed into the wellbore (often referred to as "downhole valves"). These surface and downhole valves can be operated to regulate pressure in the wellbore, to control production flow from the wellbore and to provide access to the wellbore in the event further completion work is needed. A pump jack or other mechanism can provide lift that assists in extracting hydrocarbons from the reservoir, especially in instances where the pressure in the well is so low that the hydrocarbons do not flow freely to the surface. Flow from an outlet valve of the production tree is normally connected to a distribution network of midstream facilities, such as tanks, pipelines and transport vehicles, which transport the production to downstream facilities, such as refineries and export terminals.

The various stages of creating a hydrocarbon well often include challenges that are addressed to successfully develop the well. During the drilling stage, a well operator may have to monitor the condition of the wellbore to ensure it is advancing in a suitable trajectory, and it is not experiencing issues that may jeopardize the drilling of the wellbore or the overall success of the well. For example, during drilling of a wellbore, a well operator may continually monitor the wellbore for evidence of instability, including deformation and expansion of the wellbore, such as keyseats, washouts, drilling-induced fractures (DIFs) and breakouts (BOs). A keyseat can include a small-diameter channel worn into the side of a larger diameter wellbore, caused, for example, by a sharp change in direction of the wellbore. A keyseat may include an asymmetrical erosion of the wellbore wall due to mechanical impact of the drilling components on the wellbore walls, resulting from a change in the wellbore azimuth or deviation (or "dogleg") or differential mechanical wear of hard and soft rock. A washout can include an enlarged region of a wellbore, caused, for example, by weak or unconsolidated formation rock, formation rock weakened by drilling fluids, high bit jet velocity, or mechanical wear by downhole components. A washout may include an enlarged wellbore cross section in all directions around the wellbore. DIFs and BOs can be systematically explained in terms of hoop stresses around a wellbore, and can be used to assess stress and strength of formation rock around the wall of a wellbore. A DIF includes a localized tensile deformation of a wellbore wall, such as a crack, caused when a tensile hoop stress exceeds the tensile strength of the rock at the location of the DIF. A breakout (BO) can include a localized shear deformation of a wellbore wall, manifested as localized rock spalling of the borehole, caused when a compressive hoop stress at the location of the BO exceeds the unconfined compressive strength of the rock at the location. DIFs and BOs typically occur offset from one another by 90 degrees (°). For example, sets of DIFs may occur oriented at about 0° and 180° along a length of a wellbore, accompanied by BOs oriented at about 90° and 270° along the length of a wellbore.

SUMMARY

Applicant has recognized that understanding, predicting and minimizing wellbore instability, including wellbore deformation and expansion, can be critical to successfully drilling and operating a well. Operating a hydrocarbon well, such as an oil well, can be difficult, especially in instances in which the wellbore of the well is drilled into formation rock that is susceptible to failures, including breakouts (BOs) and drilling-induced fractures (DIFs). Applicant has also identified an additional mode of failure, spider web borehole failure (SWBF), which can be critical to understand to successfully drill and operate a well, and have developed techniques for identifying, characterizing and minimizing the occurrences and effects of spider web borehole failures (SWBFs).

Applicant has recognized the four universally identified and reported wellbore deformation phenomena: keyseats, washouts, BOs and drilling-induced fractures (DIFs). The initiation and enlargement of BOs are symptomatic of compressive hoop stresses in the wellbore reaching and exceeding the compressive strength of the formation rock forming the wall of the wellbore and DIFs are symptomatic of tensile hoop stresses in the wellbore reaching and exceeding the tensile strength of the formation rock forming the wall of the wellbore. Existing techniques often attribute the enlargement to falling-off of formation rock (or "spalling") due to compressive shear failure at the formation rock forming the wall of the wellbore, induced by maximum compressive stress on opposite sides of the wall of the wellbore. Further, existing techniques often use this relationship and the angular width of BOs and DIFs observed in a wellbore to identify maximum and minimum horizontal in-situ stresses ($\sigma_H$ and $\sigma_h$), using Kirsch's equation (Kirsch, 1898), described in more detail with regard to at least Equation 1. Applicant has recognized that existing techniques generally attribute wellbore enlargement to BOs, and in some instances, keyseats and washouts, and do not consider other modes of failure, such as SWBFs. As a result, existing techniques may not recognize the true cause of wellbore instability and enlargement, which can lead to misrepresentation of the stresses occurring at the wall of the wellbore and, in turn, inaccurate predictions of failure of the formation rock at the wall of the wellbore.

Recognizing these and other shortcomings of existing techniques, Applicant has developed techniques for identifying failure of formation rock at the walls of wellbores by way of SWBF—a failure mode that is not considered or accounted for by existing techniques—and have developed techniques for inhibiting the occurrence of, and reducing the effects of, the failure of formation rock at the walls of wellbores by way of SWBF. In some embodiments, a SWBF in a well is identified based on the presence of asymmetric borehole failure in a wellbore of the well. This can include regions of spalling of formation rock that are not diametrically opposed in the wall of wellbore or are not of a similar angular width. These asymmetric characteristics may be attributable to natural fractures occurring in the formation rock. The natural fractures may create areas of reduced rock strength that exhibit spalling failure at relatively low stress levels in comparison to the stress level required to cause spalling of non-fractured rock. As a result, the spalling may follow the natural fractures, resulting in spalling patterns that are relatively asymmetric in comparison to the relatively linear spalling patterns of traditional BOs.

In some embodiments, in response to identifying a SWBF in a wellbore of a well, forward modeling of the wellbore is conducted to generate a rock strength reduction function for the well. The rock strength reduction function may define a rock strength reduction factor (r) as a function of the angular width of a borehole failure (W). The rock strength reduction factor (r) may define a ratio of an unconfined compressive strength of fractured rock ($C_{frm}$) to an unconfined compressive strength of intact formation rock ($C_o$). That is, the rock strength reduction factor (r) may represent a reduction in compressive strength of formation rock that is attributable to fractures present in the formation rock. The forward modeling may include determining a predicted angular width of a borehole failure (W) for each of a plurality of different unconfined compressive strengths of formation rock ($C_o'$) and corresponding rock strength reduction factors (r). In some embodiments, an angular width of the SWBF ($W_{SWBF}$) is determined and applied to the rock strength reduction function to determine a corresponding rock strength reduction factor (r) for the well. In some embodiments, the rock strength reduction factor (r) for the well is multiplied by the unconfined compressive strength of intact formation rock ($C_o$) for the well to determine an unconfined compressive strength of fractured rock ($C_{frm}$) for the well. In some embodiments, in-situ stresses for the well, such as the maximum and minimum horizontal in-situ stresses ($\sigma_H$ and $\sigma_h$) in the wellbore of the well, are determined using the unconfined compressive strength of fractured rock ($C_{frm}$) for the well, as opposed to the unconfined compressive strength of intact formation rock ($C_o$) for the well. In some embodiments, the well, or other wells in the same formation, are operated based on the unconfined compressive strength of fractured rock ($C_{frm}$) for the well or the in-situ stresses for the well determined using the unconfined compressive strength of fractured rock ($C_{frm}$) for the well.

Provided in some embodiments is a method of operating a hydrocarbon well. The method includes the following: conducting testing of the hydrocarbon well to acquire well data indicative of characteristics of a wellbore of the hydrocarbon well; determining, based on the well data, an unconfined compressive strength of intact rock ($C_o$) corresponding to a compressive strength of intact formation rock at a wall of the wellbore; identifying, based on the well data, asymmetric spalling of the formation rock at the wall of the wellbore; determining, based on the asymmetric spalling of the formation rock at the wall of the wellbore, that the wellbore is experiencing a SWBF; and in response to determining that the wellbore is experiencing the SWBF: generating a forward model of rock strength for the hydrocarbon well, the forward model of rock strength for the hydrocarbon well including a rock strength reduction function defining a rock strength reduction factor (r) as a function of angular width of a borehole failure (W); determining an angular width of the SWBF ($W_{SWBF}$); determining, based on application of the angular width of the SWBF ($W_{SWBF}$) to the rock strength reduction function, a rock strength reduction factor (r) for the hydrocarbon well; determining, based on the rock strength reduction factor (r) for the hydrocarbon well and the unconfined compressive strength of intact rock ($C_o$), an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

In some embodiments, operating the hydrocarbon well based on the unconfined compressive strength of fractured rock ($C_{frm}$) includes: determining a drilling fluid weight based on the unconfined compressive strength of fractured rock ($C_{frm}$); and drilling the wellbore of the well using drilling fluid of the determined drilling fluid weight. In certain embodiments, operating the hydrocarbon well based on the unconfined compressive strength of fractured rock ($C_{frm}$) includes: determining parameters of an injection operation based on the unconfined compressive strength of fractured rock ($C_{frm}$); and conducting an injection operation at the well in accordance with the parameters of the injection operation. In some embodiments, operating the hydrocarbon well based on the unconfined compressive strength of fractured rock ($C_{frm}$) includes: determining, based on the unconfined compressive strength of fractured rock ($C_{frm}$), a circumferential hoop stress ($\sigma_{\theta\theta}$) for the hydrocarbon well; and operating the hydrocarbon well based on the circumferential hoop stress ($\sigma_{\theta\theta}$) for the hydrocarbon well. In certain embodiments, identifying asymmetric spalling of the formation rock at the wall of the wellbore includes determining that regions of spalling of the formation rock at the wall of the wellbore are not diametrically opposed. In some embodiments, identifying asymmetric spalling of the formation rock at the wall of the wellbore includes determining that regions of spalling of the formation rock at the wall of the wellbore are not of similar angular widths. In certain embodiments, conducting testing of the hydrocarbon well to acquire well data indicative of characteristics of a wellbore of the hydrocarbon well includes conducting an ultrasonic logging operation to acquire an ultrasonic image of the wall of the wellbore, and the well data includes the ultrasonic image of the wall of the wellbore. In some embodiments, the method further includes: conducting testing of a second hydrocarbon well to acquire second well data indicative of second characteristics of a second wellbore of the second hydrocarbon well; determining, based on the second well data, a second unconfined compressive strength of intact rock ($C_o$) corresponding to a compressive strength of intact formation rock in the second wellbore; identifying, based on the second well data, symmetric spalling of the formation rock at a wall of the second wellbore; determining, based on the symmetric spalling of the formation rock at the wall of the second wellbore, that the second wellbore is experiencing a borehole failure; and in response to determining that the second wellbore is experiencing the borehole failure: determining, based on the second unconfined compressive strength of intact rock ($C_o$), a circumferential hoop stress ($\sigma_{\theta\theta}$) for the second hydrocarbon well; and operating the second hydrocarbon well based on the circumferential hoop stress ($\sigma_{\theta\theta}$) for the second hydrocarbon well. In certain embodiments, the method further includes, in response to determining that the wellbore is experiencing the SWBF, conducting a calibration operation including: for one or more depths in the wellbore: identifying core sample characteristics including characteristics of natural fractures of a core sample of formation rock extracted from the depth in the wellbore; identifying image characteristics including characteristics of images of rock forming the wall of the wellbore at the depth in the wellbore; and associating the core sample characteristics with the image characteristics; and generating, based on the associated core sample characteristics and image characteristics for each of the one or more depths in the wellbore, a mapping of core sample characteristics to image characteristics, where the mapping can be used to identify characteristics of formation rock based on characteristics of images of the formation rock.

Provided in some embodiments is a method that includes the following: identifying asymmetric spalling of formation rock at a wall of a wellbore of a hydrocarbon well; determining, based on the asymmetric spalling of the formation rock at the wall of the wellbore, that the wellbore is experiencing a SWBF; and in response to determining that the wellbore is experiencing the SWBF: generating a forward model of rock strength for the hydrocarbon well, the forward model of rock strength for the hydrocarbon well including a rock strength reduction function defining a rock strength reduction factor (r) as a function of angular width of a borehole failure (W); determining an angular width of the SWBF ($W_{SWBF}$); determining, based on application of the angular width of the SWBF ($W_{SWBF}$) to the rock strength reduction function, a rock strength reduction factor (r) for the hydrocarbon well; determining, based on the rock strength reduction factor (r) for the hydrocarbon well and an unconfined compressive strength of intact rock ($C_o$) corresponding to a compressive strength of intact formation rock at the wall of the wellbore, an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

In some embodiments, operating the hydrocarbon well based on the unconfined compressive strength of fractured rock ($C_{frm}$) includes: determining a drilling fluid weight based on the unconfined compressive strength of fractured rock ($C_{frm}$); and drilling the wellbore of the well using drilling fluid of the determined drilling fluid weight. In certain embodiments, operating the hydrocarbon well based on the unconfined compressive strength of fractured rock ($C_{frm}$) includes: determining parameters of an injection operation based on the unconfined compressive strength of fractured rock ($C_{frm}$); and conducting an injection operation at the well in accordance with the parameters of the injection operation. In some embodiments, operating the hydrocarbon well based on the unconfined compressive strength of fractured rock ($C_{frm}$) includes: determining, based on the unconfined compressive strength of fractured rock ($C_{frm}$), a circumferential hoop stress ($\sigma_{\theta\theta}$) for the hydrocarbon well; and operating the hydrocarbon well based on the circumferential hoop stress ($\sigma_{\theta\theta}$) for the hydrocarbon well. In certain embodiments, identifying asymmetric spalling of the formation rock at the wall of the wellbore includes determining that regions of spalling of the formation rock at the wall of the wellbore are not diametrically opposed. In some embodiments, identifying asymmetric spalling of the formation rock at the wall of the wellbore includes determining that regions of spalling of the formation rock at the wall of the wellbore are not of similar angular widths. In certain embodiments, the method further includes conducting an ultrasonic logging operation to acquire an ultrasonic image of the wall of the wellbore, and the asymmetric spalling of formation rock at the wall of the wellbore of the hydrocarbon well is based on the ultrasonic image of the wall of the wellbore. In some embodiments, the method further includes: identifying symmetric spalling of formation rock at a wall of a second wellbore of a second hydrocarbon well; determining, based on the symmetric spalling of the formation rock at the wall of the second wellbore, that the second wellbore is experiencing a borehole failure; and in response to determining that the second wellbore is experiencing the borehole failure: determining a second unconfined compressive strength of intact rock ($C_o$) corresponding to a compressive strength of intact formation rock in the second wellbore; determining, based on the second unconfined compressive strength of intact rock ($C_o$), a circumferential hoop stress ($\sigma_{\theta\theta}$) for the second hydrocarbon well; and operating the second hydrocarbon well based on the circumferential hoop stress ($\sigma_{\theta\theta}$) for the second hydrocarbon well.

Provided in some embodiments is a system that includes: a processor; and a non-transitory computer readable storage medium including program instructions stored thereon that are executable by the processor to perform the following operations: identifying asymmetric spalling of formation rock at a wall of a wellbore of a hydrocarbon well; determining, based on the asymmetric spalling of the formation rock at the wall of the wellbore, that the wellbore is experiencing a SWBF; and in response to determining that the wellbore is experiencing the SWBF: generating a forward model of rock strength for the hydrocarbon well, the forward model of rock strength for the hydrocarbon well including a rock strength reduction function defining a rock strength reduction factor (r) as a function of angular width of a borehole failure (W); determining an angular width of the SWBF ($W_{SWBF}$); determining, based on application of the angular width of the SWBF ($W_{SWBF}$) to the rock strength reduction function, a rock strength reduction factor (r) for the hydrocarbon well; determining, based on the rock strength reduction factor (r) for the hydrocarbon well and an unconfined compressive strength of intact rock ($C_o$) corresponding to a compressive strength of intact formation rock at the wall of the wellbore, an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

In some embodiments, operating the hydrocarbon well based on the unconfined compressive strength of fractured rock ($C_{frm}$) includes: determining a drilling fluid weight based on the unconfined compressive strength of fractured rock ($C_{frm}$); and drilling the wellbore of the well using drilling fluid of the determined drilling fluid weight. In certain embodiments, operating the hydrocarbon well based on the unconfined compressive strength of fractured rock ($C_{frm}$) includes: determining parameters of an injection operation based on the unconfined compressive strength of fractured rock ($C_{frm}$); and conducting an injection operation at the well in accordance with the parameters of the injection operation. In some embodiments, operating the hydrocarbon well based on the unconfined compressive strength of fractured rock ($C_{frm}$) includes: determining, based on the unconfined compressive strength of fractured rock ($C_{frm}$), a circumferential hoop stress ($\sigma_{\theta\theta}$) for the hydrocarbon well; and operating the hydrocarbon well based on the circumferential hoop stress ($\sigma_{\theta\theta}$) for the hydrocarbon well. In certain embodiments, identifying asymmetric spalling of the formation rock at the wall of the wellbore includes determining that regions of spalling of the formation rock at the wall of the wellbore are not diametrically opposed. In some embodiments, identifying asymmetric spalling of the formation rock at the wall of the wellbore includes determining that regions of spalling of the formation rock at the wall of the wellbore are not of similar angular widths. In certain embodiments, the operations further including conducting an ultrasonic logging operation to acquire an ultrasonic image of the wall of the wellbore, and the asymmetric spalling of formation rock at the wall of the wellbore of the hydrocarbon well is based on the ultrasonic image of the wall of the wellbore. In some embodiments, the method further includes: identifying symmetric spalling of formation rock at a wall of a second wellbore of a second hydrocarbon well; determining, based on the symmetric spalling of the formation rock at the wall of the second wellbore, that the second wellbore is experiencing a borehole failure; and in response to determining that the second wellbore is experiencing the borehole failure: determining a second unconfined compressive strength of intact rock ($C_o$) corresponding to a compressive strength of intact formation rock in the second wellbore; determining, based on the second unconfined compressive strength of intact rock ($C_o$), a circumferential hoop stress ($\sigma_{\theta\theta}$) for the second hydrocarbon well; and operating the second hydrocarbon well based on the circumferential hoop stress ($\sigma_{\theta\theta}$) for the second hydrocarbon well.

Provided in some embodiments is a non-transitory computer readable storage medium including program instructions stored thereon that are executable by a processor to perform the following operations: identifying asymmetric spalling of formation rock at a wall of a wellbore of a hydrocarbon well; determining, based on the asymmetric spalling of the formation rock at the wall of the wellbore, that the wellbore is experiencing a SWBF; and in response to determining that the wellbore is experiencing the SWBF: generating a forward model of rock strength for the hydrocarbon well, the forward model of rock strength for the hydrocarbon well including a rock strength reduction function defining a rock strength reduction factor (r) as a function of angular width of a borehole failure (W); determining an angular width of the SWBF ($W_{SWBF}$); determining, based on application of the angular width of the SWBF ($W_{SWBF}$) to the rock strength reduction function, a rock strength reduction factor (r) for the hydrocarbon well; determining, based on the rock strength reduction factor (r) for the hydrocarbon well and an unconfined compressive strength of intact rock ($C_o$) corresponding to a compressive strength of intact formation rock at the wall of the wellbore, an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

BRIEF DESCRIPTION OF THE DRAWINGS

FIG. 5 is a table that illustrates example well data, including example rock mechanical parameters, in accordance with one or more embodiments.

FIGS. 6A and 6B are diagrams that illustrate forward modeling in accordance with one or more embodiments.

Figure 1:
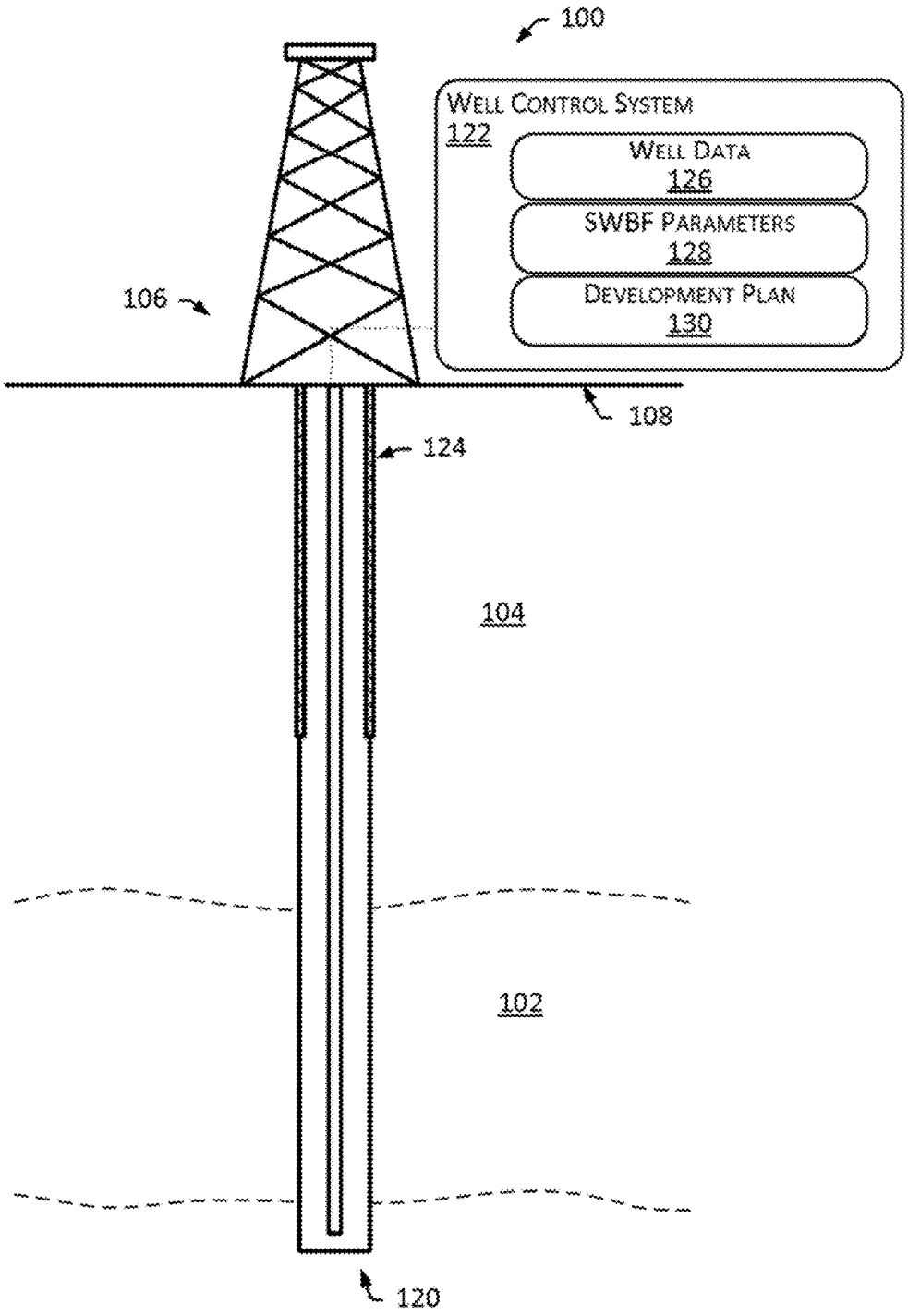
FIG. 1 is diagram that illustrates a well environment, in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of novel systems and methods for identifying and characterizing failure of formation rock in the wellbore of wells by way of spider web borehole failure (SWBF), and for inhibiting the occurrence of, and reducing the effects of, the failure of formation rock at the walls of wellbores of wells by way of SWBF. In some embodiments, a SWBF in a well is identified based on the presence of asymmetric borehole failure in a wellbore of the well. This can include regions of spalling of formation rock that are not diametrically opposed in the wall of a wellbore or are not of a similar angular width. These asymmetric characteristics may be attributable to natural fractures occurring in the formation rock. The natural fractures may create areas of reduced rock strength that exhibit spalling failure at relatively low stress levels in comparison to the stress level required to cause spalling of non-fractured rock. As a result, the spalling may follow the natural fractures, resulting in spalling patterns that are relatively asymmetric in comparison to the relatively linear spalling patterns of traditional BOs.

In some embodiments, in response to identifying a SWBF in a wellbore of a well, forward modeling of the wellbore is conducted to generate a rock strength reduction function for the well. The rock strength reduction function may define a rock strength reduction factor (r) as a function of the angular width of a borehole failure (W). The rock strength reduction factor (r) may define a ratio of an unconfined compressive strength of fractured rock ($C_{frm}$) to an unconfined compressive strength of intact formation rock ($C_o$). That is, the rock strength reduction factor (r) may represent a reduction in compressive strength of formation rock that is attributable to fractures present in the formation rock. The forward modeling may include determining a predicted angular width of a borehole failure (W) for each of a plurality of different unconfined compressive strengths of formation rock ($C_o'$) and corresponding rock strength reduction factors (r). In some embodiments, an angular width of the SWBF ($W_{SWBF}$) is determined and applied to the rock strength reduction function to determine a corresponding rock strength reduction factor (r) for the well. In some embodiments, the rock strength reduction factor (r) for the well is multiplied by the unconfined compressive strength of intact formation rock ($C_o$) for the well to determine an unconfined compressive strength of fractured rock ($C_{frm}$) for the well. In some embodiments, in-situ stresses for the well, such as the maximum and minimum horizontal in-situ stresses ($\sigma_H$ and $\sigma_h$) in the wellbore of the well, are determined using the unconfined compressive strength of fractured rock ($C_{frm}$) for the well, as opposed to the unconfined compressive strength of intact formation rock ($C_o$) for the well. In some embodiments, the well, or other wells in the same formation, are operated based on the unconfined compressive strength of fractured rock ($C_{frm}$) for the well or the in-situ stresses for the well determined using the unconfined compressive strength of fractured rock ($C_{frm}$) for the well. Although certain embodiments are described in the context of developing hydrocarbon wells, the techniques described may be applied in other context, such as in the development of water wells and other types of wells.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104, and a well system ("well") 106.

The formation 104 may include a porous or fractured rock formation that resides underground, beneath the Earth's surface ("surface") 108. The reservoir 102 may be a hydrocarbon reservoir, and the well 106 may be a hydrocarbon well, such as an oil well. In the case of the well 106 being a hydrocarbon well, the reservoir 102 may be a hydrocarbon reservoir defined by a portion of the formation 104 that contains (or that is at least determined to or expected to contain) a subsurface pool of hydrocarbons, such as oil and gas. The formation 104 and the reservoir 102 may each include different layers of rock having varying characteristics, such as varying degrees of permeability, porosity, and fluid saturations. In the case of the well 106 being operated as a production well, the well 106 may facilitate the extraction of hydrocarbons (or "production") from the reservoir 102. In the case of the well 106 being operated as an injection well, the well 106 may facilitate the injection of substances, such as gas or water, into the reservoir 102. In the case of the well 106 being operated as a monitoring well, the well 106 may facilitate the monitoring of various characteristics of the formation 104 or the reservoir 102, such reservoir pressure.

The well 106 may include a wellbore 120 and a well control system ("control system") 122. The control system 122 may control various operations of the well 106, such as well drilling operations, well completion operations, well production operations, or well and formation monitoring operations. In some embodiments, the control system 122 includes a computer system that is the same as or similar to that of computer system 1000 described with regard to at least FIG. 7.

During drilling operations, drilling fluid, such as drilling mud, may be circulated in the wellbore 120. This can provide hydrostatic pressure to support wall of the wellbore 120, to prevent formation fluids from flowing into the wellbore 120, to cool and clean a drill bit, and to carry drill cuttings away from a drill bit and out of the wellbore 120. During a well logging operation, a logging tool may be lowered into the wellbore 120 and be operated to measure characteristics of the wellbore 120 as it is moved along a length of the wellbore 120. In some instances, the measurements are recorded in a corresponding well log that provides a mapping of the measurements versus depth in the wellbore 120. During completion operations, various components may be installed (e.g., casing or production tubing) in the wellbore 120, or certain operations may be undertaken (e.g., injection operations including pumping substances into the wellbore 120 to fracture the reservoir 102 or clean the wellbore 120) to make the well 106 ready to produce hydrocarbons. During production operations, a drilling rig used to drill the well 106 may be removed and replaced with a collection of valves (or "production tree"). The production tree may be employed to regulate pressure in the wellbore 120, to control production flow from the wellbore 120, and to provide access to the wellbore 120. Flow from an outlet valve of the production tree may be coupled to a distribution network, such as pipelines, storage tanks, and transport vehicles used to transport the production to refineries and export terminals.

The wellbore 120 (or "borehole") may include a bored hole that extends from the surface 108 into a target zone of the formation 104, such as the reservoir 102. An upper end of the wellbore 120, at or near the surface 108, may be referred to as the "up-hole" end of the wellbore 120. A lower end of the wellbore 120, terminating in the formation 104, may be referred to as the "down-hole" end of the wellbore 120. The wellbore 120 may be created, for example, by a drill bit boring through the formation 104 and the reservoir 102. The wellbore 120 may provide for the circulation of drilling fluids during drilling operations, the flow of hydrocarbons (e.g., oil and gas) from the reservoir 102 to the surface 108 during production operations, the injection of substances (e.g., water) into the formation 104 or the reservoir 102 during injection operations, or the communication of monitoring devices (e.g., logging tools) into one or both of the formation 104 and the reservoir 102 during monitoring operations (e.g., during in situ logging operations). In some embodiments, the wellbore 120 includes cased or uncased (or "open-hole") portions. A cased portion may include a portion of the wellbore 120 lined with casing 124 (e.g., the up-hole end of the wellbore 120 lined with casing pipe and cement). An uncased portion may include a portion of the wellbore 120 not lined with casing 124 (e.g., the open-hole, down-hole end of the wellbore 120).

In some embodiments, the control system 122 stores, or otherwise has access to, well data 126. The well data 126 may include data that is indicative of various characteristics of the well 106, the formation 104 or the reservoir 102. The well data 126 may include, for example, a well location, a well trajectory, well logs (e.g., caliper logs, ultrasonic logs, resistivity logs or density logs for the well 106), and well and formation characteristics. A well location may include coordinates defining the location at which the up-hole end of the wellbore 120 penetrates the earth's surface 108. A well trajectory may include coordinates defining a path of the wellbore 120, from the up-hole end of the wellbore 120 to a down-hole end of the wellbore 120.

In some embodiments, the control system 122 stores, or otherwise has access to, SWBF parameters 128. The SWBF parameters 128 may specify values for use in identifying and characterizing SWBFs. The SWBF parameters 128 may be predefined, for example, by a well operator. The SWBF parameters 128 may include a specified SWBF angular offset threshold ($\phi_{SWBFthres}$), a specified opposing failure angular offset threshold ($\phi_{OPPthres}$), or a specified SWBF angular width threshold ($W_{thres}$). The specified threshold angular offset ($\phi_{thres}$) may be 5°, indicating that opposing spallings may be determined to be diametrically opposed (symmetrical) if the angular offset ($\phi_{SWBF}$) between the two spallings is in the range of 175° to 185°, and may be determined to be non-diametrically opposed (asymmetrical) if the angular offset ($\phi_{SWBF}$) between the two spallings is outside the range of 175° to 185°. The opposing failure angular offset threshold ($\phi_{OPPthres}$) may be 10°, indicating that opposing spallings may be determined to be non-diametrically opposed if the angular offset ($\phi_{SWBF}$) between the two spallings is in the range of 170° to 1750 or 185°-190°. The SWBF angular width threshold ($W_{thres}$) may be 10%, indicating that opposing spallings may be determined to be of similar size (symmetrical or a "mirror-image" of each other) if their angular widths are within 10% of one another, and may be determined to not be of similar size (asymmetrical) if their angular widths are not within 10% of one another.

As described, the control system 122 may assess the formation 104 and the wellbore 120 to determine whether the wellbore 120 is experiencing borehole failures, or to characterize borehole failures in the wellbore 120. For example, the control system 122 may identify and characterize a SWBF in the wellbore 120 based on ultrasonic image logs (or "acoustic image logs") of the well 106. In some embodiments, the control system 122 determines characteristics of the well 106 based on the presence or absence of borehole failures in the well 106 and associated characteristics. For example, in response to identifying a SWBF in the wellbore 120, the control system 122 may characterize the formation rock around the wellbore 120 as has having an unconfined compressive strength corresponding to fractured rock. In some embodiments, the control system 122 controls operation of the well 106 based on the identification or characterization of the borehole failures. For example, the control system 122 may determine drilling parameters (e.g., a drilling fluid weight (or "mud weight")) or injection parameters (e.g., an injection rate) based on the identification and characterization of a SWBF in the wellbore 120, and control the well 106 to operate in accordance with the parameters.

In some embodiments, the control system 122 generates, stores or executes a well development plan 130. A well development plan 130 may specify parameters for developing the well 106 (or other wells in the formation 104) to inhibit wellbore failures, including SWBFs. The parameters may specify parameters for drilling fluid used to drill the well 106 (or other wells in the formation 104) to inhibit the occurrence of, and reduce the effects of, SWBFs, such as a particular weight of drilling fluid (e.g., balanced weight drilling fluid), or a drilling fluid additive (e.g., lost circulation materials (LCMs)). The parameters may specify completion parameters for the well 106 (or other wells in the formation 104) to inhibit the occurrence of, and reduce the effects of, SWBFs, such as certain intervals of the wellbore 120 to be cased. The parameters may specify production operating parameters for the well 106 (or other wells in the formation 104) to inhibit the occurrence of, and reduce the effects of, SWBFs, such as production rates and pressures. The parameters may specify simulation parameters for the well 106 (or other wells in the formation 104) to inhibit the occurrence of, and reduce the effects of, SWBFs, such as constraints including use of drilling fluid having equal to or less than a threshold drilling fluid density, installing casing in wellbore segments susceptible to SWBFs, or operating at or below a maximum production rate or at or above a minimum bottom-hole pressure (BHP).

Figure 2A:
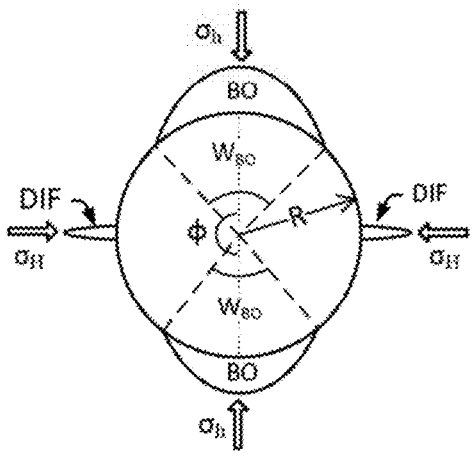
FIGS. 2A and 2B are cross-sectional diagrams of a wellbore that illustrate example hoop stresses acting on the wellbore and associated modes of failure, in accordance with one or more embodiments.
Figure 2B:
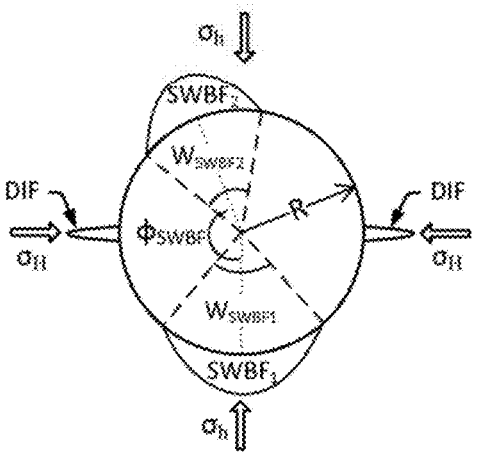

Understanding in-situ stresses of a formation and resulting modes of borehole failure can be helpful in understanding the described embodiments. FIGS. 2A and 2B are cross-sectional diagrams of a wellbore that illustrate example hoop stresses acting on the wellbore and associated modes of failure, in accordance with one or more embodiments. FIG. 2A illustrates examples of BOs and DIFs type failures. FIG. 2B illustrates examples of SWBFs and DIF type failures. Each of the diagrams illustrates locations of maximum horizontal in-situ stresses ($\sigma_H$) and locations of minimum horizontal in-situ stresses ($\sigma_h$) in a circular wellbore of a radius (R). As illustrated, the locations of maximum horizontal in-situ stresses ($\sigma_H$) may be located opposite one another, and the locations of minimum horizontal in-situ stresses ($\sigma_h$) may be located opposite one another and offset from the locations of maximum horizontal in-situ stresses ($\sigma_H$) by an angle of about 90°. One of the locations of maximum horizontal in-situ stress ($\sigma_H$) may be assigned an orientation or angular location on the wellbore circumference ($\theta$) of 0° for the purpose of further assessment, including application of Kirsch's equation (described in more detail with regard to at least Equation 1). As illustrated, BOs may occur parallel to the direction of minimum horizontal in-situ stresses ($\sigma_h$). The BOs may occur due to a resulting compressive hoop stress acting on the formation rock in the area of the BOs exceeding a compressive strength ($C_o$) of the formation rock. DIFs may occur parallel to the direction of maximum horizontal in-situ stresses ($\sigma_H$). The DIF may occur due to a resulting tensile hoop stress acting on the formation rock in the area of the DIFs exceeding a tensile strength ($T_o$) of the formation rock. A wellbore that is not susceptible to SWBFs (e.g., a wellbore surrounded by intact, non-fractured formation rock) may exhibit BO or DIF type failures, but not SWBFs, as illustrated in FIG. 2A.

A wellbore that is susceptible to SWBFs (e.g., a wellbore surrounded by fractured formation rock) may experience SWBFs, in addition to DIF type failures, as illustrated in FIG. 2B. A SWBF may be characterized by asymmetrical spalling of formation rock around the wall of the wellbore. As described, the relative locations of asymmetrical spallings of a SWBF may be defined by an angular offset ($\phi_{SWBF}$)

between the spallings. As described, the extent of a SWBF may be expressed as an angular width of the SWBF ($W_{SWBF}$). As can be seen, locations of the spallings forming an SWBF (e.g., $SWBF_1$ and $SWBF_2$) may not be directly opposite from one another (e.g., $\phi_{SWBF} \neq 180°$), and may each have different sizes (e.g., $W_{SWBF1} \neq W_{SWBF2}$). Spallings may be characterized as a SWBF based on comparisons of the angular offset of the SWBF ($\phi_{SWBF}$) and the angular width of the SWBF ($W_{SWBF}$) to an SWBF angular offset threshold ($\phi_{SWBFthres}$), an opposing failure angular offset threshold ($\phi_{OPPthres}$), and a specified SWBF angular width threshold ($W_{thres}$). The occurrence of a SWBF can make it difficult to assess the characteristics of the formation rock and, thus, in turn, can make it difficult to assess how best to operate the well or other wells in the formation. Embodiments are directed to identifying and characterizing SWBFs, characterizing formation rock based on the identification and characterization of the SWBFs, and operating wells in the formation based on the identification and characterization the SWBFs and the corresponding characterizations of the formation rock.

Figure 3A:
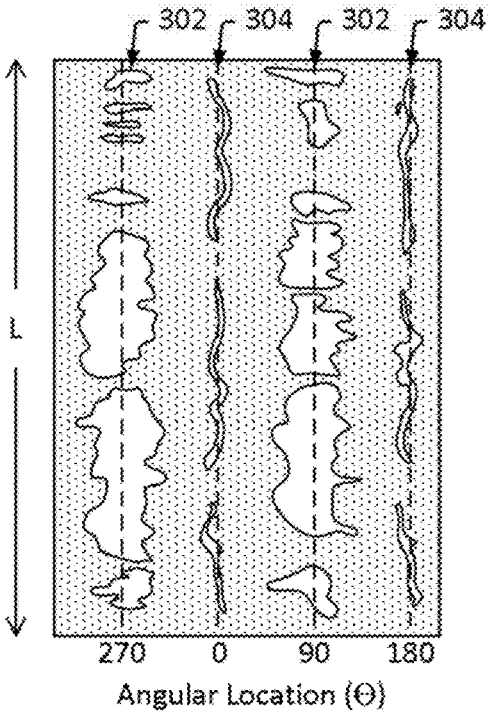
FIGS. 3A-3C are diagrams that illustrate example breakouts (BOs), drilling-induced fractures (DIFs) and spider web borehole failures (SWBFs), in accordance with one or more embodiments.
Figure 3B:
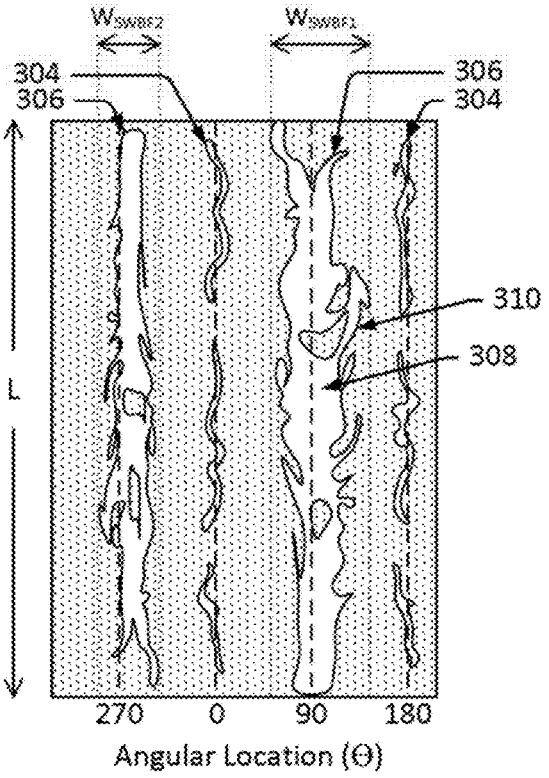
Figure 3C:
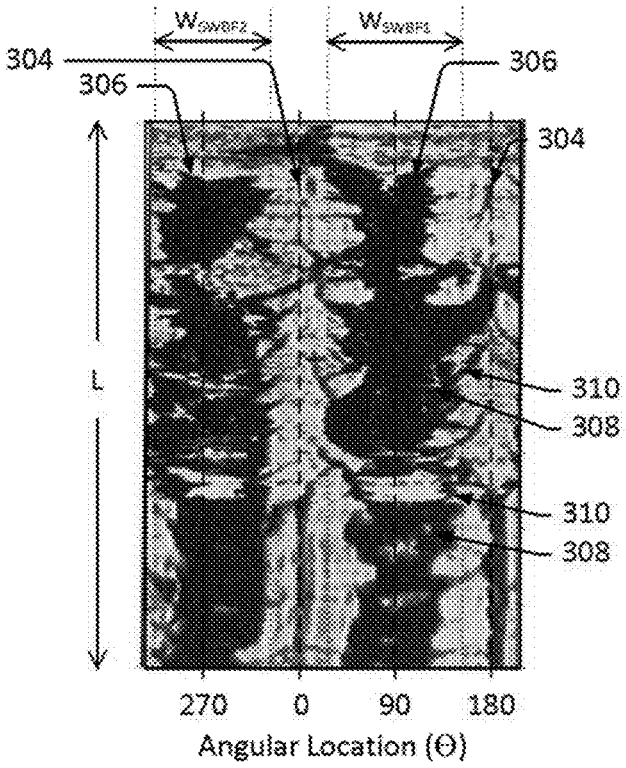

FIGS. 3A-3C are diagrams that illustrate example BOs, DIFs and SWBFs, in accordance with one or more embodiments. Each of the diagrams includes a flattened image representing formation rock around the circumference of a wellbore (e.g., from 0° to 360°), along a length of the wellbore (L). These types of images may be logs generated by way of a logging operation, such as an ultrasonic logging operation or a caliper logging operation. The angular location (θ) of 0° may be assigned to the angle at which a maximum horizontal in-situ stress ($\sigma_H$) occurs, for the purpose of consistency with further assessment of the wellbore, including application of Kirsch's equation (described in more detail with regard to at least Equation 1). In some embodiments, the angular direction of geographic North is assigned the angular location (θ) of 0° (e.g., θ=0° at the direction of geographic North). FIG. 3A is a first image of formation rock around the circumference of a wellbore experiencing BOs 302 and DIFs 304. The occurrence of BOs paired with DIFs is one mode of failure, often characterized by longitudinally oriented sets of DIFs 304 occurring along opposite lengths of the wall of the wellbore (e.g., separated from one another by an angle about 180°) at locations of minimum hoop stress (parallel to maximum horizontal in-situ stress) acting on the formation rock forming the wall of the wellbore, and longitudinally oriented sets of BOs 302 occurring along opposite lengths of the wall of the wellbore (e.g., separated from one another by an angle of about 180°) at locations of maximum hoop stress (parallel to minimum horizontal in-situ stress) acting on the formation rock forming the wall of the wellbore, with the longitudinally oriented sets of DIFs 304 and the longitudinally oriented sets of BOs 302 being offset from one another by an angle of about 90°. FIG. 3B is a second image of formation rock around the circumference of a wellbore experiencing DIFs 304 and SWBFs 306. FIG. 3C is an ultrasonic image log of formation rock around the circumference of a wellbore experiencing DIFs 304 and SWBFs 306, further illustrating the nature of SWBFs. The occurrence of SWBFs is a mode of failure recognized by Applicant. Applicant has determined that this mode of failure can include failures in locations similar to that of BOs (e.g., between location of DIFs), but the failures may be exhibit asymmetrical spalling in comparison to traditional BOs. For example, locations of spalling forming an SWBF may not be directly opposite from one another (e.g., $\phi_{SWBF} \neq 180°$), may not be of the same size (e.g., $W_{SWBF1} \neq W_{SWBF2}$), and may have an asymmetrical appearance, including areas of spalling defining a body 308 (e.g., an elongated region of failure having a rectangular shape) and legs 310 that extend from the body 308. The legs 310 may form a spider-like pattern that interconnects adjacent bodies 308 of the SWBF 306. The legs 310 may form, for example, due to natural fractures occurring in the formation rock. As described, the natural fractures may create areas of reduced rock strength that exhibit spalling failure at relatively low stress levels in comparison to the stress level required to cause spalling of non-fractured (or "intact") rock. As a result, the spalling may follow the natural fractures, resulting in spalling patterns that are relatively non-symmetric in comparison to the relatively linear spalling patterns of traditional BOs.

Applicant has recognized that SWBFs are often mistaken for BOs and, as a result, corresponding formation rock is inaccurately characterized based on characteristics of BOs. For example, an unconfined compressive rock strength may be determined for a formation based on characteristics of a BO type failure, although the failure is actually a SWBF. As a result, the formation may be designated as having a relatively high unconfined compressive rock strength associated with non-fractured formation rock, although the formation has a relatively low unconfined compressive rock strength associated with fractured formation rock. As a result, the well may be operated based on too high of an unconfined compressive rock strength, which can lead to complications in operating the well, including additional borehole failures (e.g., excessive occurrence of DIFs) that can compromise the well.

Figure 4A:
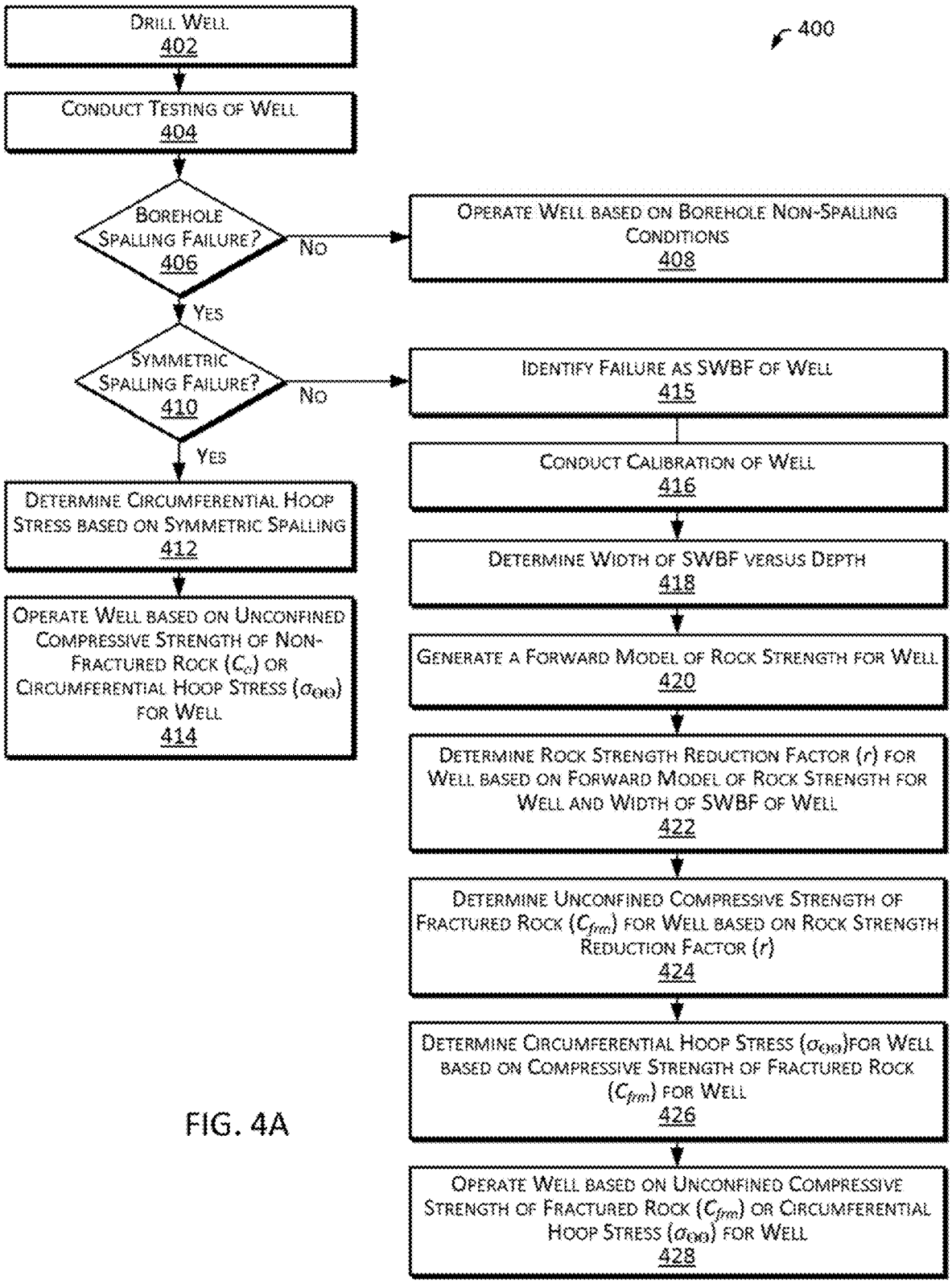
FIG. 4A is a flowchart that illustrates a method of identifying and characterizing SWBFs in a hydrocarbon well, and operating the hydrocarbon well based on the SWBFs, in accordance with one or more embodiments.

FIG. 4A is a flowchart that illustrates a method 400 of identifying and characterizing SWBFs in a hydrocarbon well, and operating the hydrocarbon well based on the SWBFs, in accordance with one or more embodiments. In the context of the well 106, the operations of the method 400 may be performed, for example, by the well control system 122 or another operator of the well 106. A processing module of the well control system 122 may perform one or more of the data processing operations described, such as those directed to determining whether the well 106 is experiencing a SWBF, characteristics of any SWBFs and corresponding characteristics of the formation 104. A well operator, such as a control module of the well control system 122 or well personnel, may operate the well 106 (or other wells in the formation 104) based on the characteristics of the formation 104. For example, an operator may operate the well 106 (or other wells in the formation 104) based on an unconfined compressive strength of fractured rock ($C_{frm}$) in the formation 104 that corresponds to an angular width ($W_{SWBF}$) of an identified SWBF.

In some embodiments, the method 400 includes drilling a well (block 402). Drilling a well may include drilling a hydrocarbon wellbore into a formation. For example, drilling the well 106 may include drilling the wellbore 120 into the formation 104.

In some embodiments, the method 400 includes conducting testing of the well (block 404). Conducting testing of the well may include performing one or more tests of a wellbore of the well to assess various characteristics of the wellbore. Testing may include well logging, injection testing, core testing, measuring a mud weight gradient (Mw) and measuring a reservoir temperature ($T_{res}$) of the well.

Well logging may include caliper logging, ultrasonic image logging, resistivity image logging, or density logging. Caliper logging of a well may include moving a caliper tool along a length of the wellbore of the well to generate size and shape data and corresponding caliper logs of the wellbore, including caliper mapping of a length of the formation rock forming the wall of the wellbore of the well. Ultrasonic image logging of a well may include moving an ultrasonic borehole imager along a length of the wellbore of the well to generate ultrasonic data and corresponding ultrasonic image logs of the wellbore, including ultrasonic images of a length of the formation rock forming the wall of the wellbore of the well. In some embodiments, caliper or ultrasonic image loggings and the corresponding caliper or ultrasonic logs are used to determine various characteristics of the wellbore and the formation, such as to identify the absence or presence of wellbore failures. This can include identifying the absence or presence of BOs, DIFs and SWBFs, and corresponding characteristics of the failures, such as locations and widths of the failures. The caliper logs may indicate the presence of borehole failure in terms of enlarged or tightened hole. However they may not provide for the detection of DIFs and SWBFs. The detection of DIFs and SWBFs may require a circumferential coverage of the wellbore wall by acoustic image logs, such as ultrasonic image logs of the wellbore. In some embodiments an SWBF may occur in a vertical or horizontal well. In a well having a horizontally oriented wellbore, the SWBF may not be detectable using acoustic image logs, but may be may be detected by other means, such as LWD (logging while drilling) borehole imaging. Thus, in the case of a well having a horizontally oriented wellbore, the wellbore may be logged using a high resolution LWD borehole imager that generates images of the wellbore that can be used to identify and characterize SWBFs in the horizontally oriented wellbore. In some embodiments, the angular location of maximum horizontal in-situ stresses ($\sigma_H$) can be determined based on the location of the borehole failures. Resistivity logging of a well may include moving a resistivity logging tool along a length of the wellbore of the well to generate resistivity data and corresponding resistivity logs of the wellbore, including a mapping of resistivity vs. depth across a length of the formation rock forming the wall of the wellbore. Density logging of a well may include moving a density logging tool along a length of the wellbore of a well to generate density data and corresponding resistivity logs of the wellbore, including a mapping of density vs. depth across a length of the formation rock forming the wall of the wellbore. In some embodiments, density loggings and the corresponding density logs are used to determine various characteristics of the wellbore and the formation, such as vertical in-situ stresses (v) of formation rock at the wall of the wellbore.

Injection testing of a well may include injecting fluid into the reservoir by way of the wellbore of the well and monitoring a pressure response in the wellbore to generate pressure versus time curves. Injection tests can include one or more of the following: micro-fracture tests, mini-fracture tests, leak-off tests and massive hydraulic fracturing. The results of the injection test can dictate, for example, the maximum pressure or mud weight that may be applied to the well during drilling operations. In some embodiments, injections tests and the corresponding results are used to determine various characteristics of the wellbore and the formation, such as a pore pressure ($P_o$), and minimum horizontal in-situ stresses ($\sigma_h$) of formation rock at the wall of the wellbore. The maximum horizontal in-situ stresses ($\sigma_H$) may be estimated using the measured formation ($P_o$), and the minimum horizontal in-situ stresses ($\sigma_h$) of formation rock at the wall of the wellbore from the injection test of the wellbore. The magnitude of vertical in-situ stress ($\sigma_v$) may be determined from integrating the rock bulk density acquired from sonic and or density logs.

Core testing may include extracting a sample of formation rock (or "core sample") from a wellbore and testing various aspects of the sample. In some embodiments, the core sample is extracted by way of a coring operation. For example, a coring operation may conducted using a coring bit to extract a cylindrical shaped sample of the formation during drilling of the wellbore of the well. The coring sample may be transported to a laboratory, where it is subjected to a variety of geologic tests to determine characteristics of the core sample and the portion of the formation surrounding the location from which the core sample was extracted. In some embodiments, core testing is employed to determine various characteristics of the wellbore and the formation, such as an unconfined compressive strength ($C_o$), internal friction and Poisson's ratio of formation rock at the wall of the wellbore.

The results of the testing of the well (e.g., including core and logs analysis), may be stored for use in assessing the well. For example, results of testing of the well 106, such as the identities and characteristics of boreholes failures (e.g., the absence or presence of BOs, DIFs and SWBF, and corresponding locations and widths of the failures), angular location of minimum horizontal in-situ stress ($\sigma_h$), maximum horizontal in-situ stresses ($\sigma_H$), magnitude of vertical in-situ stress (σv), pore pressure ($P_o$), maximum horizontal in-situ stresses ($\sigma_H$), minimum horizontal in-situ stresses ($\sigma_h$), unconfined compressive strength ($C_o$), internal friction, and Poisson's ratio of formation rock at the wall of the wellbore 120, and the mud weight gradient (Mw) and the reservoir temperature ($T_{res}$) for the well 106, may be stored in the well data 126 for the well 106. FIG. 5 is a table that illustrates an example well data 126, including example rock mechanical parameters, in accordance with one or more embodiments.

In some embodiments, method 400 includes determining whether a borehole spalling failure is present (block 406). Determining whether a borehole spalling failure is present may include determining, based on the well data for the well, whether spalling consistent with a BO, or a SWBF is present at the wall of the wellbore of the well. For example, determining whether a borehole spalling failure is present in the wellbore 120 of the well 106 may include determining whether the spalling consistent with a BO or a SWBF is present at the wall of the wellbore 120. This can include, for example, assessing ultrasonic image logs or other circumferential images of the wellbore 120 to identify the absence or presence of elongated spalling extending along a length of the walls of the wellbore 120, consistent with a BO or a SWBF.

In some embodiments, method 400 includes in response to determining that a borehole spalling failure is not present, proceeding to operating the well based on borehole non-spalling conditions (block 408). Operating the well based on borehole non-spalling conditions may include determining operating parameters of the well based on the unconfined compressive strength ($C_o$) of the intact formation rock, and a determination that the maximum circumferential hoop stress ($\sigma_{\theta\theta}^{MAX}$) is less than the unconfined compressive strength ($C_o$) of the formation rock at the wall of the wellbore, and the minimum circumferential hoop stress ($\sigma_{\theta\theta}^{MIN}$) is greater than the tensile strength ($T_o$) of the formation rock at the wall of the wellbore. For example, operating the well 106 based on borehole non-spalling conditions may include determining operating parameters, such as a drilling fluid type and weight, a production rate, an operating pressure, or an injection rate for the well 106, based on a determination that the maximum circumferential hoop stress ($\sigma_{\theta\theta}^{MAX}$) in the wellbore 120 is less than the unconfined compressive strength ($C_o$) of the rock of the formation 104 at the wall of the wellbore 120, and the minimum circumferential hoop stress ($\sigma_{\theta\theta}^{MIN}$) is greater than the tensile strength ($T_o$) of the rock of the formation 104 at the wall of the wellbore 120, and operating the well 106 in accordance with the determined operating parameters.

In some embodiments, method 400 includes, in response to determining that a borehole spalling failure is present, proceeding to determining whether the spalling failure is symmetric (block 410). Determining whether the spalling failure is symmetric may include determining whether locations of opposing spallings are diametrically opposed and are of similar size or shape consistent with a SWBF. In some embodiments, a spalling failure may be determined to be symmetric if locations of opposing spallings of the spalling failure are diametrically opposed and the opposing spallings are of similar size, and a spalling failure may be determined to be asymmetric if locations of opposing spallings of the spalling failure are not diametrically opposed or the opposing spallings are not of the same or similar size, or may be determined to be asymmetric if locations of opposing spallings exhibit a shape that is consistent with a SWBF (e.g., a body with spider-like legs).

In some embodiments, determining whether locations of opposing spallings are diametrically opposed includes determining whether the locations of the spalling are angularly offset from one another by an angle of about 180°. For example, opposing spallings may be determined to be diametrically opposed if the angular offset ($\phi_{SWBF}$) between the two spallings satisfy a specified SWBF angular offset threshold ($\phi_{SWBFthres}$) and a specified opposing failure angular offset threshold ($\phi_{OPPthres}$). Continuing with the above example, spallings may be determined to be diametrically opposed if the angular offset ($\phi_{SWBF}$) is within about 5° of 180° (e.g., $175° \leq \phi_{SWBF} \leq 185°$). Referring to FIG. 2B, spallings $SWBF_1$ and $SWBF_2$ may be determined to be diametrically opposed if the angular offset (ϕSWBF) between the two spallings is in the range of 175° to 185°, and may be determined to be non-diametrically opposed (asymmetric) if the angular offset (ϕSWBF) between the two spallings is in the range of 170° to 175° or 185°-190°. In some embodiments, the angular location of a spalling is defined as the angular direction passing through a center of the spalling region. As illustrated in FIG. 2B, the angular location of the spalling of $SWBF_1$ ($\phi_{SWBF1}$) may be defined by the dotted line bisecting the angle of the dashed lines extending to the extents of the region of the spalling occurring at the wall of the cylindrical wellbore, and the angular location of the spalling of $SWBF_2$ ($\phi_{SWBF2}$) may be defined by the dotted line bisecting the angle of the dashed lines extending to the extents of the region of the spalling of $SWBF_2$ occurring at the wall of the cylindrical wellbore.

In some embodiments, determining whether opposing spallings are of similar size includes determining whether the angular widths of the opposing spallings are similar. For example, opposing spallings may be considered to be of similar size if the difference in their angular widths satisfies the SWBF angular width threshold ($W_{thres}$). Continuing with the above example, opposing spallings may be considered to be of similar size if their angular widths are within 10% of one another. Referring to FIG. 2B, opposing spallings $SWBF_1$ and $SWBF_2$ may be determined to be of similar size if their angular widths ($W_{SWBF1}$ and $W_{SWBF2}$) are within 10% of one another, and may be determined to not be of similar size if their angular widths ($W_{SWBF1}$ and $W_{SWBF2}$) are not within 10% of one another.

In some embodiments, determining whether opposing spallings are of a shape that is consistent with a SWBF includes determining from logs (e.g., acoustic image logs) whether opposing spallings have areas of spalling defining a body (e.g., an elongated region of failure having a rectangular shape) and legs that extend from the body. The legs may form a spider-like pattern that interconnects adjacent bodies of the SWBF.

In some embodiments, method 400 includes in response to determining that the spalling failure is symmetric, proceeding to assessing characteristics of the well and to operating the well based on techniques for assessing BO and DIF type failures. In some embodiments, this includes determining circumferential hoop stress of the well based on the symmetric spalling (block 412) and operating the well based on the unconfined compressive strength of non-fractured (intact) formation rock ($C_o$) or the circumferential hoop stress for the well (block 414).

In some embodiments, determining the circumferential hoop stress of the well based on the symmetric spalling includes determining the circumferential hoop stress of the wellbore of the well using Kirsch's equation (Kirsch, 1898) for identifying hoop stresses ($\sigma_{\theta\theta}$) around a cylindrical vertical hole, defined by the following relationship:

$$\sigma_{\theta\theta}=\sigma_H+\sigma_h-2(\sigma_H-\sigma_h)\cos 2\theta-P_o-P_w \quad (1)$$

where $\sigma_{\theta\theta}$ is the circumferential hoop stress at a given angular location at the circumference of the wall of the wellbore, defined by an angle (θ) between the angular location and an angular location of the maximum horizontal in-situ stress ($\sigma_H$) at the circumference of the wall of the wellbore, $\sigma_H$ is the maximum horizontal in-situ stress around the circumference of the wall of the wellbore, $\sigma_h$ is the minimum horizontal in-situ stress around the circumference of the wall of the wellbore, $P_o$ is the formation rock pore pressure, and $P_w$ is the pressure of drilling fluid in the wellbore. In the context of the well 106, these parameters may be obtained from the well data 126 for the well 106. In some embodiments, the angular direction of geographic North is assigned as a reference for the angular location (θ) (e.g., θ=0° at the direction of geographic North). Determining circumferential hoop stress of the wellbore based on the symmetric spalling can include determining maximum and minimum horizontal in-situ stresses ($\sigma_H$ and $\sigma_h$). The maximum and minimum horizontal in-situ stresses ($\sigma_H$ and $\sigma_h$) can be determined, for example, based on modeling of the stresses of the formation rock at and around the wellbore, or the observations of the failure (or lack of failure) of formation rock along the wall of the wellbore. In some embodiments, the maximum horizontal in-situ stress ($\sigma_H$) is based on the observed angular width of BOs in the wellbore. In some embodiments, the minimum horizontal in-situ stress ($\sigma_h$) is based on the occurrence of DIFs or the occurrence and width of BOs in the wellbore. The $\sigma_h$ is also measured from injection tests of wellbore. Kirsch's equation (equation 1) expresses maximum and minimum circumferential hoop stresses around a vertical borehole in terms of maximum and minimum horizontal in-situ stresses ($\sigma_H$ and $\sigma_h$), the formation rock pore pressure ($P_o$), and the contrast (ΔP) between pore pressure ($P_o$) and drilling fluids pressure ($P_w$). The maximum circumferential hoop stress ($\sigma_{\theta\theta}^{MAX}$) can be defined as follows:

$$\sigma_{\theta\theta}^{MAX}=3\sigma_H-\sigma_h-2P_o-\Delta P-\sigma^{\Delta T} \quad (2)$$

The minimum circumferential hoop stress ($\sigma_{\theta\theta}^{MIN}$) can be defined as follows:

$$\sigma_{\theta\theta}^{MIN}=3\sigma_h-\sigma_H-2P_o-\Delta P-\sigma^{\Delta T} \quad (3)$$

where $\sigma^{\Delta T}$ is a thermal cooling stress, which is valid for high-temperature reservoirs (e.g., reservoirs with wellbores having bottom-hole temperatures of greater than about 300° F. (149° C.)). A positive circumferential hoop stress ($\sigma_{\theta\theta}$) indicates a compressive circumferential hoop stress, and a negative circumferential hoop stress ($\sigma_{\theta\theta}$) indicates a tensile circumferential hoop stress. It can be determined that BOs are likely to occur when the maximum circumferential hoop stress ($\sigma_{\theta\theta}^{MAX}$) is positive, and equal to or greater than a compressional strength ($C_o$) of the formation rock at the wall of the wellbore. It can be determined that tensile fractures, such as DIFs, are likely to occur when the minimum circumferential hoop stress ($\sigma_{\theta\theta}^{MAX}$) is negative, and less than or equal to a tensile strength ($T_o$) of the formation rock at the wall of the wellbore.

In some embodiments, operating the well based on the unconfined compressive strength of rock ($C_o$) or circumferential hoop stress for the well includes controlling characteristics of drilling fluid circulated into the wellbore during drilling operations (e.g., using an oil-based drilling fluid, as opposed to a water-based drilling fluid), drilling the well using drilling fluids having a fluid density that is within the threshold drilling fluid density (e.g., using a balanced drilling fluid in the wellbore 120 to constrain the hoop stresses (see equation 2 and 3) to a level that inhibits the development of BOs and DIFs in the wellbore 120), conducting completion or production operations to inhibit the occurrence of BOs and DIFs (e.g., casing a segment of the wellbore 120 to inhibit the BOs and DIFs in the segment of the wellbore 120), operating at or below a maximum production rate (or at or above the minimum BHP) (e.g., operating the well 106 at a maximum production rate (or at or above the minimum BHP in the wellbore 120)). In some embodiments, operating the well based on the unconfined compressive strength of rock ($C_o$) or circumferential hoop stress for the well includes operating the well based on a well design based on the unconfined compressive strength of rock ($C_o$) or the determined circumferential hoop stresses for the well.

In the context of well stimulation operations (e.g., hydraulic fracturing or "hydrofracturing"), well models, field models and well designs and associated field development plans (FDPs) inhibiting BOs and DIFs, may be constrained in view of the unconfined compressive strength of rock ($C_o$) or circumferential hoop stress for the well. A well simulation may constrain the well 106 to use of an oil based drilling fluid having equal to or less than the threshold drilling fluid density and at least the threshold amount of lost circulation materials (LCMs), casing in a segment of the wellbore 120, operating the well 106 at or below the maximum production rate, or operating the well 106 at or above a minimum BHP, in an effort to inhibit BOs and DIFs. As a further example, stimulation operations parameters may be adjusted and an injection operation may be performed using those parameters (e.g., an injection rate or pressure of the injection operation may be decreased below threshold values estimated for intact/non-fractured rock), in the wellbore 120. In some embodiments, the occurrence of SWBF in a target hydrocarbon reservoir may indicate that hydrofracture stimulation operation is not necessary to produce the hydrocarbon. In such an instance, performance of borehole cleaning by acid or other compatible fluids, or a minifracking job may be sufficient, and the borehole may flow without the need for major hydrofracturing job.

In some embodiments, method 400 includes in response to determining that the spalling failure is not symmetric (or is "asymmetric"), proceeding to identify the spalling failure as a SWBF of the well (block 415), and proceeding to assess and operate the well 106 based on characteristics of the SWBF. The assessment may including conducting a calibration operation for the well 106 and forward modeling the well 106 to identify characteristics of the well 106, and operating the well 106 based on the identified characteristics.

In some embodiments, the method 400 includes conducting a calibration operation for the well (block 416). For SWBFs a calibration with resistivity image logs or laboratory testing of drill core samples (e.g., acquired from the same wellbore at the same depth as the acoustic image logs) may be used to verify the presence of natural fractures. In some embodiments, calibrating from acoustic image logs, resistivity images and drill cores includes identifying and associating areas in each of the images and drill cores that demonstrate opposing spallings have areas of spalling defining a body (e.g., an elongated region of failure having a rectangular shape) and legs that extend from the body. The legs may form a spider-like pattern that interconnects adjacent bodies of the SWBF. The calibration operation can, for example, include the following:

(1) extracting, from each of one or more depths in a wellbore, a core sample of rock;

(2) acquiring, for each of the one or more depths in the wellbore, images of rock at the wall of the wellbore;

(3) for each of the one more depths in the wellbore, conducting an "image log analysis" that includes the following:

(a) characterizing the core sample for the depth, including, for example, identifying and characterizing natural fractures of the core sample of rock extracted from the given depth ("core sample characteristics" for the depth) (e.g., identifying locations (depths), orientations and densities of natural fractures in the core sample of rock extracted from the given depth);

(b) characterizing the images of rock at the wall of the wellbore for the depth, including, for example, identifying characteristics of the images of the rock at the wall of the wellbore at the given depth ("image characteristics" for the depth) (e.g., identifying locations (depths), orientations and widths of SWBFs in the images of rock at the wall of the wellbore for the depth), and (c) associating the core sample characteristics for the depth with the image characteristics for the depth (e.g., associating the locations (depths), orientations and densities of natural fractures in the core sample of rock extracted from the given depth with the locations (depths), orientations and widths of SWBFs in the images of rock at the wall of the wellbore for the depth); and (4) generating, using the associations for each of the one or more depths, a mapping of characteristics of natural fractures to characteristics of SWBFs identified from the images of rock (e.g., a mapping of the result of calibrating the SWBFs occurrence in the well, including a mapping of SWBFs occurrence versus natural fracture occurrence and density).

Figure 4B:
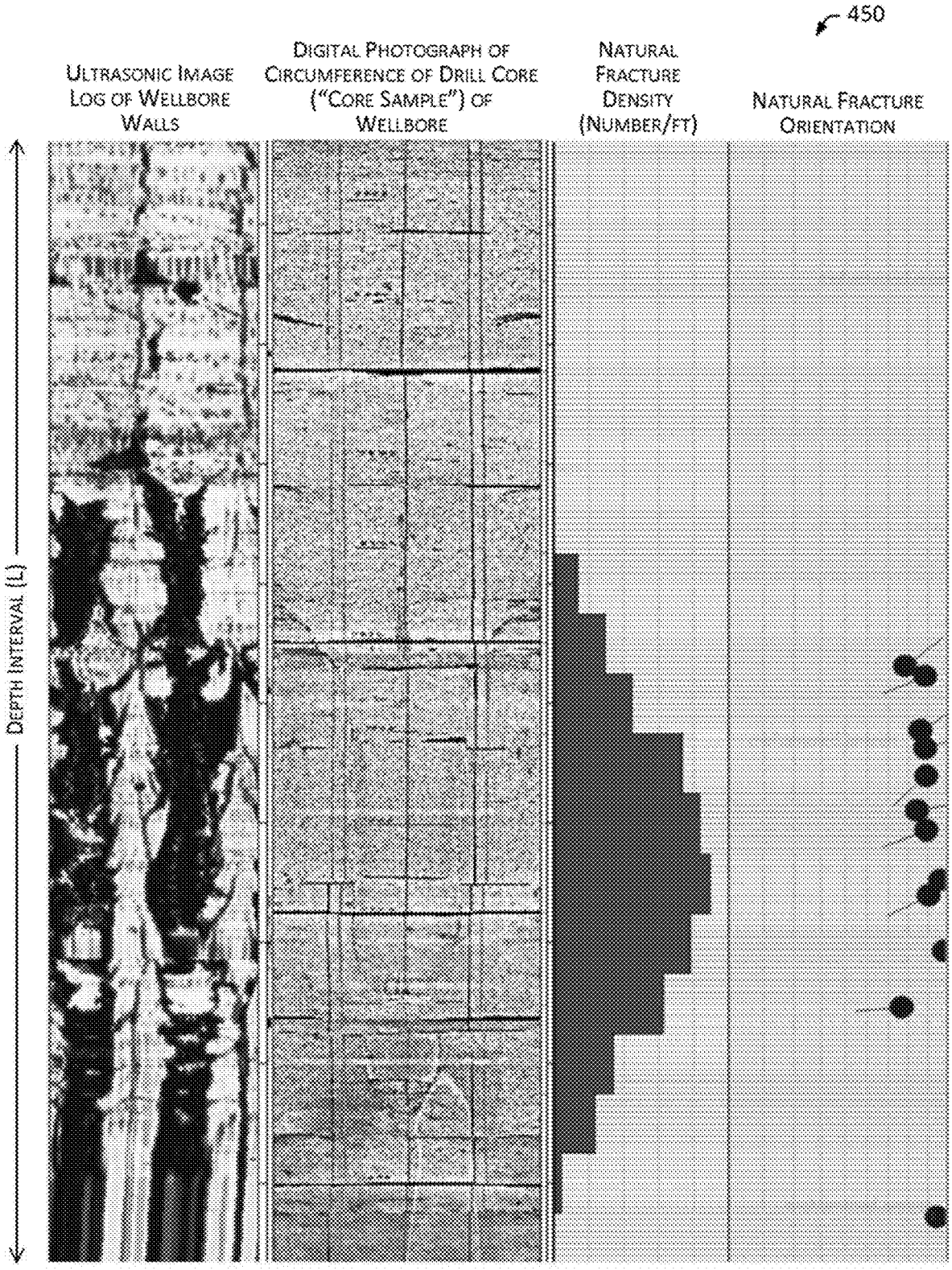
FIG. 4B is a graphic chart that illustrates example results of calibrating the SWBFs occurrence in a hydrocarbon well versus the natural fracture occurrence and density, in accordance with one or more embodiments

FIG. 4B illustrates an example mapping 450 of the result of calibrating the SWBFs occurrence in a hydrocarbon well, in accordance with one or more embodiments. The mapping 400 includes a graphic chart that illustrates mapping of SWBFs occurrence in a well versus natural fracture occurrence and density in the well. Such a mapping can be used, for example, to identify characteristics of formation rock (and natural fractures contained in the formation rock) based on characteristics of images of the formation rock. Such calibration may be essential for the first well drilled in a particular area or field to identify the presence and character of natural fractures in the particular area or field. A characterization of SWBFs from acoustic images may include, for example, the depths, angular locations and angular widths of SWBFs.

In some embodiments, the method 400 includes determining a width of the SWBF versus depth (block 418). Determining a width of the SWBF versus depth may include determining an angular width of the spalling identified as a SWBF, or angular widths of other areas of spalling identified as a SWBF at other depths in the wellbore of the well. In some embodiments, the angular width associated with the SWBF is a width of one or both of two regions of spalling associated with the SWBF. For example, referring to FIG. 2B illustrating two regions of spalling ($SWBF_1$ and $SWBF_2$) associated with a SWBF, the angular width of the SWBF may be determined to be the larger of the two angular widths (e.g., $W_{SWBF}=W_{SWBF1}$, $W_{SWBF1}>W_{SWBF2}$). That is, the angular width of the SWBF may be angular width of the most developed spalling body in terms of length and width of the SWBF body observed on acoustic borehole images. (See, e.g., FIGS. 2B, 3B and 3C). Using the larger of the two angular widths may identify a critical threshold of ($C_o$) at which spalling advances rapidly and thus poses a higher risk to wellbore stability.

In some embodiments, the method 400 includes generating a forward model of rock strength for the well (block 420). The forward model of rock strength for the well may define a rock strength reduction factor (r) as a function of angular width of a borehole failure, such as a SWBF. The rock strength reduction factor (r) may represent a ratio of an unconfined compressive strength of fractured rock ($C_{frm}$) to an unconfined compressive strength of intact rock ($C_o$). The rock strength reduction factor (r) may be defined as follows:

$$r = \frac{C_{frm}}{C_o} \tag{4}$$

Generating the forward modeling may include predicting the occurrence of BOs and DIFs, and corresponding angular widths of the BOs, in formation rock for each of various values of unconfined compressive strength of formation rock ($C_o'$). Each of the various values of unconfined compressive strength of formation rock ($C_o'$) may be less than an unconfined compressive strength of intact rock ($C_o$). The unconfined compressive strength of intact formation rock ($C_o$) may be determined, for example, by way of laboratory testing of a core sample of the formation. For example, an unconfined compressive strength of intact formation rock ($C_o$) for the well 106 stored in well data 126 may be determined by way of laboratory testing of a core sample of rock of the formation 104 extracted from the wellbore 120. The forward modeling of the well 106 may include predicting corresponding angular widths of BOs (if any) in the wellbore 120 for each of a plurality of different unconfined compressive strengths of formation rock ($C_o$), determining a rock strength reduction function defining the rock strength reduction factor (r) as a function of angular width of a borehole failure (W). In some embodiments, the angular width of a borehole failure in a wellbore for each of the plurality of different unconfined compressive strengths of formation rock ($C_o'$) is determined based on a corresponding set of input parameters, including a vertical in-situ stress ($\sigma_v$), a pore pressure ($P_o$), drilling fluids pressure ($P_w$) (where $\Delta P=P_o-P_w$), a maximum horizontal in-situ stress ($\sigma_H$), a minimum horizontal in-situ stress ($\sigma_h$), an unconfined compressive strength ($C_o$), an internal friction, and a Poisson's ratio of the formation rock at the wall of the wellbore. As described, these values may be determined based on testing of the well (block 404) or obtained from well data for the well (e.g., well data 126).

FIGS. 6A and 6B are diagrams that illustrate forward modeling in accordance with one or more embodiments. FIG. 6A is a diagram that illustrates forward modeling data for an unconfined compressive strength of intact formation rock ($C_o$) having a value 15,927 psi, and including predicting corresponding angular widths of compressional, symmetrical borehole failures (BOs) for each of the following unconfined compressive strengths of formation rock ($C_o'$): 6,200 psi; 6,100 psi; 6,050 psi; 5,500 psi; 5,000 psi; 4,500 psi; 4,000 psi; 3,000 psi; 2,000 psi; and 1,000 psi. FIG. 6B is a plot that illustrates points corresponding to the respective determined angular widths for each of the unconfined compressive strengths of formation rock ($C_o'$), and a best fit line defining a rock strength reduction function (e.g., $r=-0.005*W+0.431$) that defines the rock strength reduction factor (r) as a function of an angular width of a borehole failure (W). As described, the SWBF angular width ($W_{SWBF}$) may be substituted for the angular width of a borehole failure (W) to determine a rock strength reduction factor (r) corresponding to the SWBF.

In some embodiments, the method 400 includes determining a rock strength reduction factor (r) for the well based on the forward model of rock strength for the well and the width of the SWBF of the well (block 422). This can include applying the determined width of the SWBF of the well to the rock strength reduction function for the well to determine the rock strength reduction factor (r) for the well. For example, referring to FIGS. 6A and 6B, if the angular width of a SWBF in the well 106 ($W_{SWBF}$) is determined to be 10°, then the value of 10° may be substituted for the angular width of a borehole failure (W) in the rock strength reduction function ($r=-0.005*W+0.431$) to arrive at a rock strength reduction factor (r) of 0.381 for the well.

In some embodiments, the method 400 includes determining an unconfined compressive strength of fractured rock ($C_{frm}$) for the well based on the rock strength reduction factor (r) (block 424). This can include multiplying the unconfined compressive strength of intact formation rock ($C_o$) for the well by the rock strength reduction factor (r) for the well to arrive at the unconfined compressive strength of fractured rock ($C_{frm}$) for the well. For example, determining an unconfined compressive strength of fractured rock ($C_{frm}$) for the well 106 based on the rock strength reduction factor (r) may include multiplying the unconfined compressive strength of intact formation rock ($C_o$) for the well 106 by the rock strength reduction factor (r) for the well 106 to arrive at the an unconfined compressive strength of fractured rock ($C_{frm}$) for the well 106 of 6,068 psi (e.g., 6,068 psi=15,927 psi*0.381).

In some embodiments, the method 400 includes determining circumferential hoop stress ($\sigma_{\theta\theta}$) of the well where SWBFs have occurred based on the unconfined compressive strength of fractured rock ($C_{frm}$) for the well (block 426). In some embodiments, determining circumferential hoop stress of the well based on the unconfined compressive strength of fractured rock ($C_{frm}$) for the well includes determining maximum and minimum horizontal in-situ stresses ($\sigma_H$ and $\sigma_h$) based on the unconfined compressive strength of fractured rock ($C_{frm}$) for the well, and applying the maximum and minimum horizontal in-situ stresses ($\sigma_H$ and $\sigma_h$) to equations 1, 2 and 3 to determine hoop stress ($\sigma_{\theta\theta}$) at one or more angular locations around the wellbore of the well, maximum circumferential hoop stress ($\sigma_{\theta\theta}^{MAX}$) around the wellbore of the well, and the minimum circumferential hoop stress ($\sigma_{\theta\theta}^{MIN}$) around the wellbore of the well, respectively.

In some embodiments, method 400 includes operating the well based on the unconfined compressive strength of fractured rock ($C_{frm}$) for the well or the circumferential hoop stress of the well (block 428). This can include, for example, the control system 122 (or another operator of the well 106, such as well personnel) controlling operations of the well 106 to inhibit the occurrence of additional SWBFs, or to reduce negative effects of existing SWBFs. In some embodiments, the operating includes controlling characteristics of drilling fluid circulated into the wellbore during drilling operations. For example, operating the well 106 may include using an oil-based drilling fluid, as opposed to a water-based drilling fluid. As another example, operating the well 106 may include determining a threshold drilling fluid density to inhibit the occurrence of SWBFs (or at least minimize the effect of SWBFs), and circulating, into the wellbore 120, drilling fluids having a fluid density that is equal to the threshold drilling fluid density. A balanced fluid density may reduce the maximum hoop stress (see equation 2) to a level below that required to develop the SWBFs and thereby inhibit the occurrence of SWBFs. In some embodiments, operating the well 106 includes conducting completion or production operations to inhibit the occurrence of SWBFs. For example, if the wellbore 120 is determined to contain or SWBFs, operating the well 106 may include casing the segment of the wellbore 120 to inhibit the occurrence of additional SWBFs (or at least minimize the effect of SWBFs) in the segment of the wellbore 120. As a further example, operating the well 106 may include determining a maximum production rate (or minimum BHP) to inhibit the occurrence of SWBFs (or at least minimize the effect of SWBFs) in the wellbore 120, and operating the well 106 at or below the maximum production rate (or at or above the minimum BHP).

In the context of well design, well stimulation operations (e.g., hydraulic fracturing or "hydrofracturing"), well models, field models and field development plans (FDPs), these may be constrained by parameters to inhibit the occurrence of SWBFs. Continuing with the above example, a well simulation may constrain the well 106 to use of a drilling fluid within the threshold drilling fluid density, casing the segment of the wellbore 120 determined to have SWBFs, operating the well 106 at the maximum production rate, or operating the well 106 at or above the minimum BHP. SWBFs may indicate that stimulation operations may not be required because the natural fractures in the formation (evident from the SWBFs) may be sufficient to allow production after just cleaning the borehole by special fluids or a minifracking job. As a further example, if the well 106 is determined to exhibit SWBFs, stimulation operations parameters may be adjusted and an injection operation be performed using those parameters (e.g., an injection rate or pressure of the injection operation may be decreased below the values estimated from $C_o$ of non-fractured rock).

Figure 7:
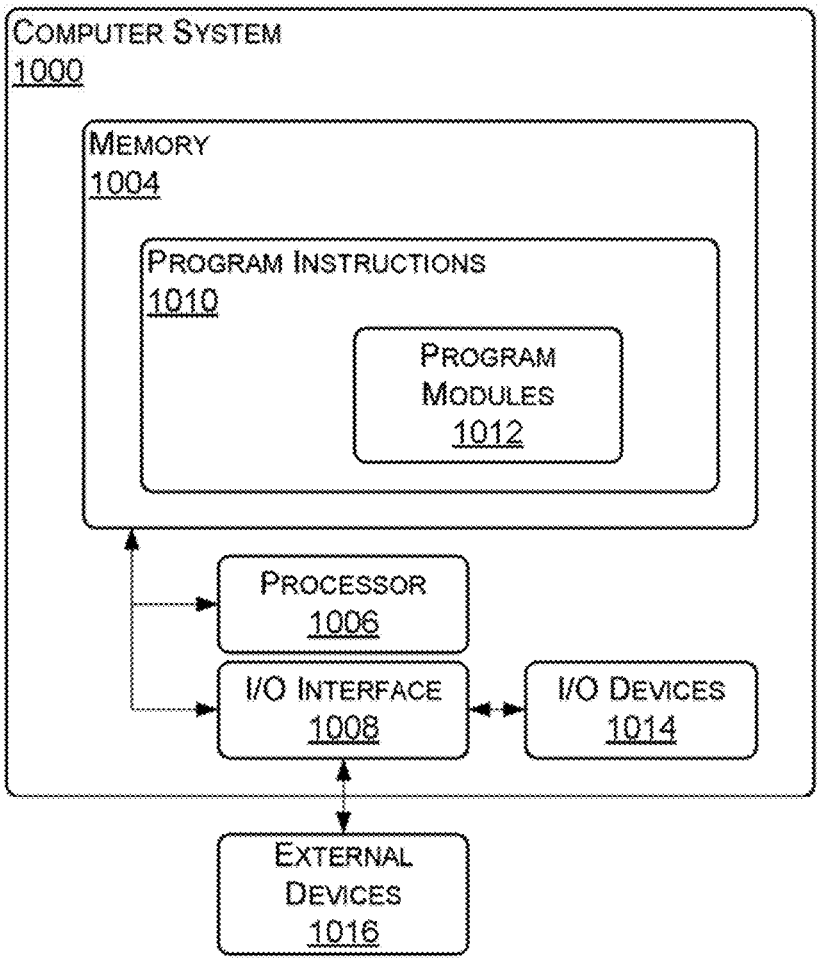
FIG. 7 is a diagram that illustrates an example computer system, in accordance with one or more embodiments.

FIG. 7 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random access memory (SRAM), synchronous dynamic RAM (SDRAM)), or bulk storage memory (for example, CD-ROM or DVD-ROM, hard drives). The memory 1004 may include a non-transitory computer-readable storage medium having program instructions 1010 stored thereon. The program instructions 1010 may include program modules 1012 that are executable by a computer processor (e.g., the processor 1006) to cause the functional operations described, such as those described with regard to the well control system 122 or the method 400.

The processor 1006 may be any suitable processor capable of executing program instructions. The processor 1006 may include a central processing unit (CPU) that carries out program instructions (e.g., the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016. In some embodiments, the I/O interface 1008 includes one or both of an antenna and a transceiver. In some embodiments, the external devices 1016 include logging tools, lab test systems, well pressure sensors, or well flowrate sensors.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as examples of embodiments. Elements and materials may be substituted for those illustrated and described herein, parts and processes may be reversed or omitted, and certain features of the embodiments may be utilized independently, all as would be apparent to one skilled in the art after having the benefit of this description of the embodiments. Changes may be made in the elements described herein without departing from the spirit and scope of the embodiments as described in the following claims. Headings used herein are for organizational purposes only and are not meant to be used to limit the scope of the description.

It will be appreciated that the processes and methods described herein are example embodiments of processes and methods that may be employed in accordance with the techniques described herein. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (e.g., by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of operating a hydrocarbon well, the method comprising:

conducting testing of the hydrocarbon well to acquire well data indicative of characteristics of a wellbore of the hydrocarbon well;

determining, based on the well data, an unconfined compressive strength of intact rock ($C_o$) corresponding to a compressive strength of intact formation rock at a wall of the wellbore;

identifying, based on the well data, asymmetric spalling of the formation rock at the wall of the wellbore;

determining, based on the asymmetric spalling of the formation rock at the wall of the wellbore, that the wellbore is experiencing a spider web borehole failure (SWBF); and in response to determining that the wellbore is experiencing the SWBF:

generating a forward model of rock strength for the hydrocarbon well, the forward model of rock strength for the hydrocarbon well comprising a rock strength reduction function defining a rock strength reduction factor (r) as a function of angular width of a borehole failure (W);

determining an angular width of the SWBF ($W_{SWBF}$);

determining, based on application of the angular width of the SWBF ($W_{SWBF}$) to the rock strength reduction function, a rock strength reduction factor (r) for the hydrocarbon well;

determining, based on the rock strength reduction factor (r) for the hydrocarbon well and the unconfined compressive strength of intact rock ($C_o$), an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

2. The method of claim 1, wherein operating the hydrocarbon well based on the unconfined compressive strength of fractured rock ($C_{frm}$) comprises:

determining a drilling fluid weight based on the unconfined compressive strength of fractured rock ($C_{frm}$); and drilling the wellbore of the well using drilling fluid of the determined drilling fluid weight.

3. The method of claim 1, wherein operating the hydrocarbon well based on the unconfined compressive strength of fractured rock ($C_{frm}$) comprises:

determining parameters of an injection operation based on the unconfined compressive strength of fractured rock ($C_{frm}$); and conducting an injection operation at the well in accordance with the parameters of the injection operation.

4. The method of claim 1, wherein operating the hydrocarbon well based on the unconfined compressive strength of fractured rock ($C_{frm}$) comprises:

determining, based on the unconfined compressive strength of fractured rock ($C_{frm}$), a circumferential hoop stress ($\sigma_{\theta\theta}$) for the hydrocarbon well; and operating the hydrocarbon well based on the circumferential hoop stress ($\sigma_{\theta\theta}$) for the hydrocarbon well.

5. The method of claim 1, wherein identifying asymmetric spalling of the formation rock at the wall of the wellbore comprises determining that regions of spalling of the formation rock at the wall of the wellbore are not diametrically opposed.

6. The method of claim 1, wherein identifying asymmetric spalling of the formation rock at the wall of the wellbore comprises determining that regions of spalling of the formation rock at the wall of the wellbore are not of similar angular widths.

7. The method of claim 1, wherein conducting testing of the hydrocarbon well to acquire well data indicative of characteristics of the wellbore of the hydrocarbon well comprises conducting an ultrasonic logging operation to acquire an ultrasonic image of the wall of the wellbore, and wherein the well data comprises the ultrasonic image of the wall of the wellbore.

8. The method of claim 1, further comprising:

conducting testing of a second hydrocarbon well to acquire second well data indicative of second characteristics of a second wellbore of the second hydrocarbon well;

determining, based on the second well data, a second unconfined compressive strength of intact rock ($C_o$) corresponding to a compressive strength of intact formation rock in the second wellbore;

identifying, based on the second well data, symmetric spalling of the formation rock at a wall of the second wellbore;

determining, based on the symmetric spalling of the formation rock at the wall of the second wellbore, that the second wellbore is experiencing a borehole failure; and in response to determining that the second wellbore is experiencing the borehole failure:

determining, based on the second unconfined compressive strength of intact rock ($C_o$), a circumferential hoop stress ($\sigma_{\theta\theta}$) for the second hydrocarbon well; and operating the second hydrocarbon well based on the circumferential hoop stress ($\sigma_{\theta\theta}$) for the second hydrocarbon well.

9. The method of claim 1, further comprising, in response to determining that the wellbore is experiencing the SWBF, conducting a calibration operation comprising:

for one or more depths in the wellbore:

identifying core sample characteristics comprising characteristics of natural fractures of a core sample of formation rock extracted from the depth in the wellbore;

identifying image characteristics comprising characteristics of images of rock forming the wall of the wellbore at the depth in the wellbore; and associating the core sample characteristics with the image characteristics; and generating, based on the associated core sample characteristics and image characteristics for each of the one or more depths in the wellbore, a mapping of core sample characteristics to image characteristics, wherein the mapping is used to identify characteristics of formation rock based on characteristics of images of the formation rock.

10. A method comprising:

identifying asymmetric spalling of formation rock at a wall of a wellbore of a hydrocarbon well;

determining, based on the asymmetric spalling of the formation rock at the wall of the wellbore, that the wellbore is experiencing a spider web borehole failure (SWBF); and in response to determining that the wellbore is experiencing the SWBF:

generating a forward model of rock strength for the hydrocarbon well, the forward model of rock strength for the hydrocarbon well comprising a rock strength reduction function defining a rock strength reduction factor (r) as a function of angular width of a borehole failure (W);

determining an angular width of the SWBF ($W_{SWBF}$);

determining, based on application of the angular width of the SWBF ($W_{SWBF}$) to the rock strength reduction function, a rock strength reduction factor (r) for the hydrocarbon well;

determining, based on the rock strength reduction factor (r) for the hydrocarbon well and an unconfined compressive strength of intact rock ($C_o$) corresponding to a compressive strength of intact formation rock at the wall of the wellbore, an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

11. The method of claim 10, wherein operating the hydrocarbon well based on the unconfined compressive strength of fractured rock ($C_{frm}$) comprises:

determining a drilling fluid weight based on the unconfined compressive strength of fractured rock ($C_{frm}$); and drilling the wellbore of the well using drilling fluid of the determined drilling fluid weight.

12. The method of claim 10, wherein operating the hydrocarbon well based on the unconfined compressive strength of fractured rock ($C_{frm}$) comprises:

determining parameters of an injection operation based on the unconfined compressive strength of fractured rock ($C_{frm}$); and conducting an injection operation at the well in accordance with the parameters of the injection operation.

13. The method of claim 10, wherein operating the hydrocarbon well based on the unconfined compressive strength of fractured rock ($C_{frm}$) comprises:

determining, based on the unconfined compressive strength of fractured rock ($C_{frm}$), a circumferential hoop stress ($\sigma_{\theta\theta}$) for the hydrocarbon well; and operating the hydrocarbon well based on the circumferential hoop stress ($\sigma_{\theta\theta}$) for the hydrocarbon well.

14. The method of claim 10, wherein identifying asymmetric spalling of the formation rock at the wall of the wellbore comprises determining that regions of spalling of the formation rock at the wall of the wellbore are not diametrically opposed.

15. The method of claim 10, wherein identifying asymmetric spalling of the formation rock at the wall of the wellbore comprises determining that regions of spalling of the formation rock at the wall of the wellbore are not of similar angular widths.

16. The method of claim 10, further comprising conducting an ultrasonic logging operation to acquire an ultrasonic image of the wall of the wellbore, and wherein the asymmetric spalling of formation rock at the wall of the wellbore of the hydrocarbon well is based on the ultrasonic image of the wall of the wellbore.

17. The method of claim 10, further comprising:

identifying symmetric spalling of formation rock at a wall of a second wellbore of a second hydrocarbon well;

determining, based on the symmetric spalling of the formation rock at the wall of the second wellbore, that the second wellbore is experiencing a borehole failure; and in response to determining that the second wellbore is experiencing the borehole failure:

determining a second unconfined compressive strength of intact rock ($C_o$) corresponding to a compressive strength of intact formation rock in the second wellbore;

determining, based on the second unconfined compressive strength of intact rock ($C_o$), a circumferential hoop stress ($\sigma_{\theta\theta}$) for the second hydrocarbon well; and operating the second hydrocarbon well based on the circumferential hoop stress ($\sigma_{\theta\theta}$) for the second hydrocarbon well.

18. A system comprising:

a processor; and a non-transitory computer readable storage medium comprising program instructions stored thereon that are executable by the processor to perform the following operations:

identifying asymmetric spalling of formation rock at a wall of a wellbore of a hydrocarbon well;

determining, based on the asymmetric spalling of the formation rock at the wall of the wellbore, that the wellbore is experiencing a spider web borehole failure (SWBF); and in response to determining that the wellbore is experiencing the SWBF:

generating a forward model of rock strength for the hydrocarbon well, the forward model of rock strength for the hydrocarbon well comprising a rock strength reduction function defining a rock strength reduction factor (r) as a function of angular width of a borehole failure (W);

determining an angular width of the SWBF ($W_{SWBF}$);

determining, based on application of the angular width of the SWBF ($W_{SWBF}$) to the rock strength reduction function, a rock strength reduction factor (r) for the hydrocarbon well;

determining, based on the rock strength reduction factor (r) for the hydrocarbon well and an unconfined compressive strength of intact rock ($C_o$) corresponding to a compressive strength of intact formation rock at the wall of the wellbore, an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

19. The system of claim 18, wherein operating the hydrocarbon well based on the unconfined compressive strength of fractured rock ($C_{frm}$) comprises:

determining a drilling fluid weight based on the unconfined compressive strength of fractured rock ($C_{frm}$); and drilling the wellbore of the well using drilling fluid of the determined drilling fluid weight.

20. The system of claim 18, wherein operating the hydrocarbon well based on the unconfined compressive strength of fractured rock ($C_{frm}$) comprises:

determining parameters of an injection operation based on the unconfined compressive strength of fractured rock ($C_{frm}$); and conducting an injection operation at the well in accordance with the parameters of the injection operation.

21. The system of claim 18, wherein operating the hydrocarbon well based on the unconfined compressive strength of fractured rock ($C_{frm}$) comprises:

determining, based on the unconfined compressive strength of fractured rock ($C_{frm}$), a circumferential hoop stress ($\sigma_{\theta\theta}$) for the hydrocarbon well; and operating the hydrocarbon well based on the circumferential hoop stress ($\sigma_{\theta\theta}$) for the hydrocarbon well.

22. The system of claim 18, wherein identifying asymmetric spalling of the formation rock at the wall of the wellbore comprises determining that regions of spalling of the formation rock at the wall of the wellbore are not diametrically opposed.

23. The system of claim 18, wherein identifying asymmetric spalling of the formation rock at the wall of the wellbore comprises determining that regions of spalling of the formation rock at the wall of the wellbore are not of similar angular widths.

24. The system of claim 18, the operations further comprising conducting an ultrasonic logging operation to acquire an ultrasonic image of the wall of the wellbore, and wherein the asymmetric spalling of formation rock at the wall of the wellbore of the hydrocarbon well is based on the ultrasonic image of the wall of the wellbore.

25. The system of claim 18, further comprising:

identifying symmetric spalling of formation rock at a wall of a second wellbore of a second hydrocarbon well;

determining, based on the symmetric spalling of the formation rock at the wall of the second wellbore, that the second wellbore is experiencing a borehole failure; and in response to determining that the second wellbore is experiencing the borehole failure:

determining a second unconfined compressive strength of intact rock ($C_o$) corresponding to a compressive strength of intact formation rock in the second wellbore;

determining, based on the second unconfined compressive strength of intact rock ($C_o$), a circumferential hoop stress ($\sigma_{\theta\theta}$) for the second hydrocarbon well; and operating the second hydrocarbon well based on the circumferential hoop stress ($\sigma_{\theta\theta}$) for the second hydrocarbon well.

26. A non-transitory computer readable storage medium comprising program instructions stored thereon that are executable by a processor to perform the following operations:

identifying asymmetric spalling of formation rock at a wall of a wellbore of a hydrocarbon well;

determining, based on the asymmetric spalling of the formation rock at the wall of the wellbore, that the wellbore is experiencing a spider web borehole failure (SWBF); and in response to determining that the wellbore is experiencing the SWBF:

generating a forward model of rock strength for the hydrocarbon well, the forward model of rock strength for the hydrocarbon well comprising a rock strength reduction function defining a rock strength reduction factor (r) as a function of angular width of a borehole failure (W);

determining an angular width of the SWBF ($W_{SWBF}$);

determining, based on application of the angular width of the SWBF ($W_{SWBF}$) to the rock strength reduction function, a rock strength reduction factor (r) for the hydrocarbon well;

determining, based on the rock strength reduction factor (r) for the hydrocarbon well and an unconfined compressive strength of intact rock ($C_o$) corresponding to a compressive strength of intact formation rock at the wall of the wellbore, an unconfined compressive strength of fractured rock ($C_{frm}$) corresponding to a compressive strength of fractured formation rock at the wall of the wellbore; and operating the hydrocarbon well based on the unconfined compressive strength of fractured rock ($C_{frm}$).

* * * * *